US011998152B2

(12) United States Patent
Moon et al.

(10) Patent No.: US 11,998,152 B2
(45) Date of Patent: Jun. 4, 2024

(54) NOZZLE OF CLEANER AND METHODS FOR CONTROLLING SAME

(71) Applicant: LG ELECTRONICS INC., Seoul (KR)

(72) Inventors: Byungryul Moon, Seoul (KR); Seungbae Jung, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 563 days.

(21) Appl. No.: 17/264,640

(22) PCT Filed: Jul. 18, 2019

(86) PCT No.: PCT/KR2019/008884
§ 371 (c)(1),
(2) Date: Jan. 29, 2021

(87) PCT Pub. No.: WO2020/027469
PCT Pub. Date: Feb. 6, 2020

(65) Prior Publication Data

US 2021/0315433 A1 Oct. 14, 2021

(30) Foreign Application Priority Data

Jul. 30, 2018 (KR) ..... 10-2018-0088768

(51) Int. Cl.
*A47L 11/40* (2006.01)
*A47L 11/283* (2006.01)

(52) U.S. Cl.
CPC ..... *A47L 11/4069* (2013.01); *A47L 11/283* (2013.01); *A47L 11/4011* (2013.01);
(Continued)

(58) Field of Classification Search
CPC ..... A47L 11/305; A47L 11/4083; A47L 11/4088; A47L 11/283; A47L 11/4011; A47L 11/4063; A47L 11/4069
See application file for complete search history.

(56) References Cited

U.S. PATENT DOCUMENTS 9,854,956 B2 1/2018 Song et al.
11,109,732 B2 9/2021 Jang et al.
(Continued)

FOREIGN PATENT DOCUMENTS

CN 102890509 A 1/2013
CN 104055463 A 9/2014
(Continued)

OTHER PUBLICATIONS

International Search Report dated Oct. 23, 2019, in Korean Application No. PCT/KR2019/008884 (4 pages).
(Continued)

*Primary Examiner* — Andrew A Horton
(74) *Attorney, Agent, or Firm* — Birch, Stewart, Kolasch & Birch, LLP

(57) ABSTRACT

The present disclosure relates to a nozzle of a cleaner. The nozzle of a cleaner includes: a nozzle main body having a suction flow path through which air is suctioned; a first rotation cleaning unit and a second rotation cleaning unit spaced apart in a left and right direction on a lower side of the nozzle main body and including a rotation plate to which mop is attachable; a first driving device disposed on one side of a flow path extending in a front and rear direction in the suction path and including a first driving motor for driving the first rotation cleaning unit; a second driving device disposed on the other side of the flow path extending in the
(Continued)

front and rear direction in the suction path and including a second driving motor for driving the second rotation cleaning unit.

21 Claims, 33 Drawing Sheets

(52) U.S. Cl.
CPC ..... *A47L 11/4038* (2013.01); *A47L 11/4044* (2013.01); *A47L 11/4083* (2013.01); *A47L 11/4088* (2013.01)

(56) References Cited

U.S. PATENT DOCUMENTS

| | | | |
|---|---|---|---|
| 2018/0035858 | A1 | 2/2018 | Jung et al. |
| 2018/0049613 | A1 | 2/2018 | Tsuboi et al. |
| 2018/0192843 | A1 | 7/2018 | Kwak |

FOREIGN PATENT DOCUMENTS

| | | | |
|---|---|---|---|
| CN | 107405036 | A | 11/2017 |
| CN | 107615203 | A | 1/2018 |
| CN | 108024682 | A | 5/2018 |
| JP | 2012-086604 | | 5/2012 |
| JP | 2012-105845 | A | 6/2012 |
| KR | 20-1992-0016332 | U | 9/1992 |
| KR | 10-0400515 | | 10/2001 |
| KR | 2001-0093648 | A | 10/2001 |
| KR | 10-2008-0020304 | | 3/2008 |
| KR | 10-0848568 | B1 | 7/2008 |
| KR | 10-2017-0030803 | A | 3/2017 |
| KR | 10-2017-0053351 | | 5/2017 |
| KR | 10-2018-0008248 | | 1/2018 |
| TW | 201707636 | A | 3/2017 |
| WO | WO 2012/088804 | A1 | 6/2012 |

OTHER PUBLICATIONS

Office Action dated Aug. 25, 2021 in Chinese Application No. 201980048756.4 (13 pages).

NOZZLE OF CLEANER AND METHODS FOR CONTROLLING SAME

CROSS-REFERENCES TO RELATED APPLICATIONS

This application is the National Phase of PCT International Application No. PCT/KR2019/008884, filed on Jul. 18, 2019, which claims priority under 35 U.S.C. § 119(e) to Korean Application No. 10-2018-0088768, filed on Jul. 30, 2018. The entire contents of the above-referenced applications are incorporated herein by reference.

TECHNICAL FIELD

The present disclosure relates to a nozzle of a cleaner and a method for controlling the same.

BACKGROUND

The cleaner is a device which suctions or wipes dust or foreign matter in a region to be cleaned to perform a cleaning.

Such a cleaner can be classified into a manual cleaner for performing cleaning while a user directly moves the cleaner and an automatic cleaner for performing cleaning while traveling itself.

The manual cleaner can be classified into a canister-type cleaner, an upright-type cleaner, a handy-type cleaner, and a stick-type cleaner, according to the type of the cleaner.

These cleaners can clean a floor using nozzles. In general, nozzles can be used so as to suction air and dust. According to the type of the nozzle, the nozzle may be attached with a mop to clean the floor with the mop.

Korean Patent Registration No. 10-0405244, which is a related art 1, discloses a suction port assembly for a vacuum cleaner.

The suction port assembly of the related art 1 includes a suction port main body provided with a suction port.

The suction port main body includes a first suction path in the front, a second suction path in the rear, and a guide path formed between the first suction path and the second suction path.

A mop is rotatably installed on the lower end of the suction port main body, and a rotation driving unit for driving the mop is provided in the suction port main body.

The rotation driving unit includes one rotation motor and gears for transmitting the power of the one rotation motor to a plurality of rotating bodies to which mops are attached.

Meanwhile, according to the related art 1, since a pair of rotating bodies disposed on both sides of the rotation driving unit are rotated using one rotating motor, if the rotating motor fails or malfunctions, there is a problem that all of the pair of rotating bodies cannot be rotated.

So as to rotate the pair of rotating bodies using the one rotation motor, since the rotation motor is positioned at the center of the suction port main body, it is necessary to design a suction path for preventing interference with the rotation motor, and thus there are disadvantages that the length of the suction path is lengthened and the structure for forming a suction path is complicated.

Since the related art 1 does not have a structure for supplying water to a mop, in a case where cleaning is desired to be performed using a mop with water, there is a disadvantage that a user has to directly supply water to a mop.

On the other hand, Korean Patent Laid-Open Publication No. 10-2017-0028765, which is the related art 2, discloses a cleaner.

The cleaner disclosed in the related art 2 includes a cleaner main body in which a mop is rotatably installed on a lower portion thereof, a water bottle which is mounted to a handle which is connected to the cleaner main body or the cleaner main body, a water spray nozzle which is installed so as to spray water to the front of the cleaner main body, and a water supply unit for supplying the water in the water tank to the water spray nozzle.

In a case of the related art 2, since the water spray nozzle is sprayed forward from a front surface of the cleaner main body, there is a possibility that the sprayed water may wet other nearby structures, not a mop.

The water spray nozzle is disposed at the center of the cleaner main body, while the mop is arranged in the lateral direction, there is a problem that the mop cannot sufficiently absorb the water sprayed forward of the cleaner main body.

In a case of the related art 2, since there is no flow path for suctioning air, there is a disadvantage that only the floor can be wiped, and foreign matters present on the floor have to be manually cleaned again by the user.

In addition, in the case of a conventional wet mop cleaner, a feature in which a pair of driving motors are provided and a pair of rotating plates and a mop, interlocked with the driving motors, rotates while mopping the floor has been disclosed.

At this time, when the rotation speeds of the driving motors on both sides are different from each other, a head portion to which the mop is fixed may be difficult to go straight. In detail, when the rotation speeds of the driving motors are different from each other, the head portion generates a force to move in the lateral direction rather than the front direction. In particular, a force to move in a direction in which the rotation speed is relatively slow is generated.

In order to move the head portion forward, a user has to hold a handle connected to the upper side of the head portion with greater force and push the handle forward with greater force.

That is, when the rotation speeds of the driving motors disposed on both sides are different from each other, the straightness of the head portion to which the mop is coupled decreases, and the user has to operate the handle while exerting more force to advance a nozzle main body. In addition, the user's operating convenience is degraded and the user's fatigue is inevitably increased.

SUMMARY

Technical Problem

The present disclosure provides a nozzle of a cleaner capable of suctioning foreign matter on the floor surface, cleaning the floor by rotating the mop, and supplying water with the mop.

In addition, the present disclosure provides a nozzle of a cleaner through which water from a water tank can be stably supplied to a rotation cleaning unit during a cleaning process.

In addition, the present disclosure provides a nozzle of a cleaner that reduces flow path loss by preventing an increase in the length of an air flow path through which air flows, even when a structure capable of cleaning the floor using a mop is applied.

In addition, the present disclosure provides a nozzle of a cleaner capable of increasing the amount of water stored in a water tank while minimizing an increase in the height of the nozzle.

In addition, the present disclosure provides a nozzle of a cleaner that can secure a cleaning area by a mop even with a small amount of movement when cleaning using the nozzle.

In addition, the present disclosure provides a nozzle of a cleaner in which the weights of a plurality of driving devices are uniformly distributed left and right.

In addition, the present disclosure provides a nozzle of a cleaner that prevents the center of gravity of the nozzle from shifting toward the driving device in a state in which a water tank is mounted.

In addition, the present disclosure provides a nozzle of a cleaner that prevents water discharged through a water supply flow path from being introduced into a nozzle main body.

In addition, the present disclosure provides a nozzle of a cleaner in which the length of a water supply flow path for supplying water from a water tank to a rotation cleaning unit is minimized.

In addition, the present disclosure provides a nozzle of a cleaner in which leakage of water discharged from a water tank is minimized.

In addition, the present disclosure provides a nozzle of a cleaner in which the same amount of water can be supplied to each rotation cleaning unit.

In addition, the present disclosure provides a nozzle of a cleaner and a method for controlling the same, which can prevent a nozzle main body from changing a direction arbitrarily or shifting toward one side by rotating mops disposed on both sides of the nozzle main body at the same or similar speeds, and can improve the straight running performance of the nozzle main body.

In addition, the present disclosure provides a nozzle of a cleaner and a method for controlling the same, in which since a user can operate a handle connected to a nozzle main body without exerting great effort, the user's convenience of operation during the cleaning process can be improved and the user fatigue can be reduced.

In addition, the present disclosure provides a nozzle of a cleaner and a method for controlling the same, in which a user can more easily change a traveling direction of a nozzle main body with less force without exerting great force.

Technical Solution

According to one aspect of the present disclosure, which is provided for achieving the above objects, a nozzle of a cleaner includes: a nozzle main body having a suction path through which air is suctioned; a first rotation cleaning unit and a second rotation cleaning unit spaced apart in a left and right direction on a lower side of the nozzle main body and including a rotation plate to which mop is attachable; a first driving device disposed on one side of a flow path extending in a front and rear direction in the suction path and including a first driving motor for driving the first rotation cleaning unit; a second driving device disposed on the other side of the flow path extending in the front and rear direction in the suction path and including a second driving motor for driving the second rotation cleaning unit; a water tank detachably mounted on an upper side of the nozzle main body and configured to store water to be supplied to each of the first and second rotation cleaning units; and a water supply path provided in the nozzle main body and communicating with the water tank so as to supply water from the water tank to each of the first and second rotation cleaning units.

In addition, the nozzle may include: a first sensing unit configured to sense a rotation speed of the first driving motor; a second sensing unit configured to sense a rotation speed of the second driving motor; and a control unit configured to receive the rotation speeds of the first and second driving motors sensed by the first and second sensing units and control the rotation speeds of the first and second driving motors.

The control unit may be configured to compare the rotation speeds of the first and second driving motors sensed by the first and second sensing units, and selectively adjust the rotational speeds of the first and second driving motors according to a comparison result.

The control unit may be configured to control an output to increase a rotation speed of a driving motor having a relatively low rotation speed when a difference between the rotation speeds of the first and second driving motors is greater than a reference value.

The control unit may be configured to control an output to decrease a rotation speed of a driving motor having a relatively high rotation speed when a difference between the rotation speeds of the first and second driving motors is greater than a reference value.

The control unit may be configured to maintain the rotation speeds of the first and second driving motors when a difference between the rotation speeds of the first and second driving motors is less than or equal to a reference value.

In addition, the nozzle may further include a direction detection sensor configured to sense a change in a traveling direction of the nozzle main body and transmit the sensed change to the control unit.

In addition, when the direction detection sensor senses a direction change of the nozzle main body to a left side, the control unit may be configured to control an output so that the rotation speed of the first driving motor disposed on the left is less than the rotation speed of the second driving motor disposed on the right.

In addition, when the direction detection sensor senses a direction change of the nozzle main body to a right side, the control unit may be configured to control an output so that the rotation speed of the second driving motor disposed on the right is less than the rotation speed of the first driving motor disposed on the left.

According to one aspect of the present disclosure, a method for controlling a nozzle of a cleaner includes: turning on first and second driving motors; detecting, by first and second sensing units, rotation speeds of the first and second driving motors, respectively; comparing, by a control unit, the rotation speeds of the first and second driving motors; and selectively adjusting the rotation speeds of the first and second driving motors according to a comparison result.

In addition, when it is determined from the comparison result that a difference between the rotation speeds of the first and second driving motors is greater than a reference value, the control unit may control an output to increase a rotation speed of a driving motor having a relatively low rotation speed.

In addition, when it is determined from the comparison result that a difference between the rotation speeds of the first and second driving motors is greater than a reference value, the control unit may control an output to decrease a rotation speed of a driving motor having a relatively high rotation speed.

According to another aspect of the present disclosure, a method for controlling a nozzle of a cleaner includes: turning on first and second driving motors; detecting, by a direction detection sensor, a change in a traveling direction of a nozzle main body; and selectively adjusting rotation speeds of the first and second driving motors according to whether the direction of the nozzle main body is changed.

In addition, when a direction change of the nozzle main body to a left side is detected, the control unit may control an output so that the rotation speed of the first driving motor disposed on the left is less than the rotation speed of the second driving motor disposed on the right.

In addition, when a direction change of the nozzle main body to a right side is detected, the control unit may control an output so that the rotation speed of the second driving motor disposed on the right is less than the rotation speed of the first driving motor disposed on the left.

Advantageous Effects

According to the proposed disclosure, a flow path through which foreign matter on the floor surface can be suctioned is provided, and a rotation plate to which mops are attached is rotated, thereby improving the floor cleaning performance.

In addition, since a water tank is mounted on the nozzle to supply water with mops, there is an advantage of increasing user convenience.

In addition, since a water pump can be operated by a pump motor, water from the water tank can be stably supplied to the rotation cleaning unit during a cleaning process.

In addition, since a flow path extends from the center of the nozzle in the front and rear direction and driving devices for rotating the rotation cleaning unit are disposed on both sides of the flow path, it is possible to prevent an increase in the length of an air flow path through which air flows, thereby preventing an increase in flow path loss.

In addition, the water tank is divided into two chambers left and right, the two chambers communicate in the front portion of the water tank, and the two chambers are disposed to surround around the driving device. Therefore, the storage amount of the water tank can be increased while minimizing the increase in the height of the nozzle.

In addition, when the diameter of the mop is formed to be 0.6 times or more than half the left and right width of the nozzle main body, the area in which the mop can clean a floor facing the nozzle main body may be increased, and the area in which the mop can clean the floor not facing the nozzle main body may be increased. Therefore, even when the nozzle is moved less, the floor surface of the same area can be cleaned using the mop.

In addition, since the two driving devices are disposed on both sides of the second flow path extending in the front and rear direction, there is an advantage that the weight of the driving devices can be evenly distributed from the nozzle to the left and right.

In addition, since a connection chamber connecting the two chambers in the water tank is positioned between the first flow path and a plurality of driving devices, the center of gravity of the nozzle can be prevented from shifting toward the rear of the nozzle.

In addition, according to the present disclosure, since a spray nozzle connected to the end of the water supply flow path is exposed to the outside of a nozzle housing, water sprayed from the spray nozzle can be prevented from entering the nozzle housing.

In addition, according to the present disclosure, since one discharge port is formed in the water tank and the water supply flow path branches water to supply water to each of the plurality of rotation cleaning units, there is an advantage in that a portion of water leakage is minimized.

In addition, according to the present disclosure, since the discharge port and the water pump are positioned at one side of the second flow path among the suction flow paths, there is an advantage that the length of the water supply flow path is minimized.

In addition, according to the present disclosure, since a connector to which branch tubes are connected is positioned at the upper side of the second flow path, substantially the same amount of water can be supplied to each rotation cleaning unit.

In addition, according to the present disclosure, there is an advantage that can prevent a nozzle main body from changing a direction arbitrarily or shifting toward one side by rotating mops disposed on both sides of the nozzle main body at the same or similar speeds, and can improve the straight running performance of the nozzle main body.

In addition, according to the present disclosure, since a user can operate a handle connected to a nozzle main body without exerting great effort, the user's convenience of operation during the cleaning process can be improved and the user fatigue can be reduced.

In addition, according to the present disclosure, the user can more easily change a traveling direction of a nozzle main body with less force without exerting great force.

DETAILED DESCRIPTION

Figure 1:
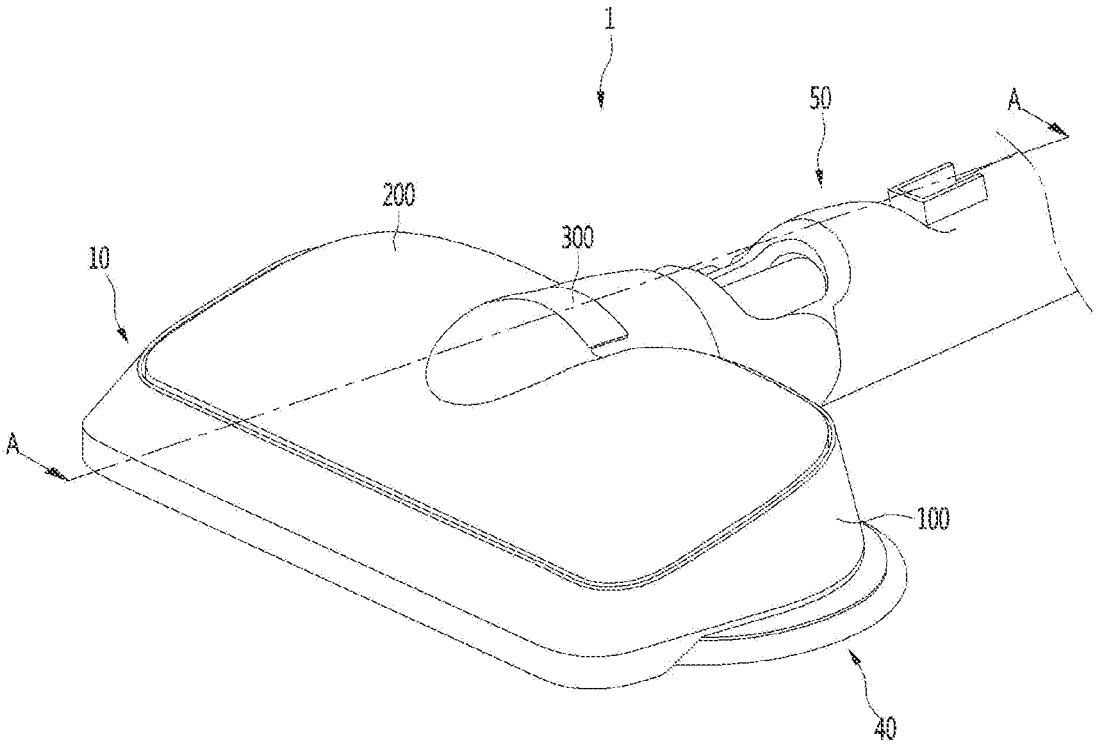
FIG. 1 and FIG. 2 are perspective views illustrating a nozzle of a cleaner according to an embodiment of the present disclosure.

Hereinafter, some embodiments of the present disclosure are described in detail with reference to exemplary drawings. It should be noted that when components in the drawing are designated by reference numerals, the same components have the same reference numerals as far as possible even though the components are illustrated in different drawings. Further, in description of embodiments of the present disclosure, when it is determined that detailed descriptions of well-known configurations or functions disturb understanding of the embodiments of the present disclosure, the detailed descriptions will be omitted.

Also, the terms 'first', 'second', 'A', '(a)', and '(b)' can be used in the following description of the components of embodiments of the present disclosure. The terms are provided only for discriminating components from other components and, does not delimit an essence, an order or a sequence of the corresponding component. When a component is described as being "connected", "combined", or "coupled" with another component, the former may be directly connected or joined to the latter, but it should be understood that the former may be connected or coupled to the latter with a third component interposed therebetween.

Figure 2:
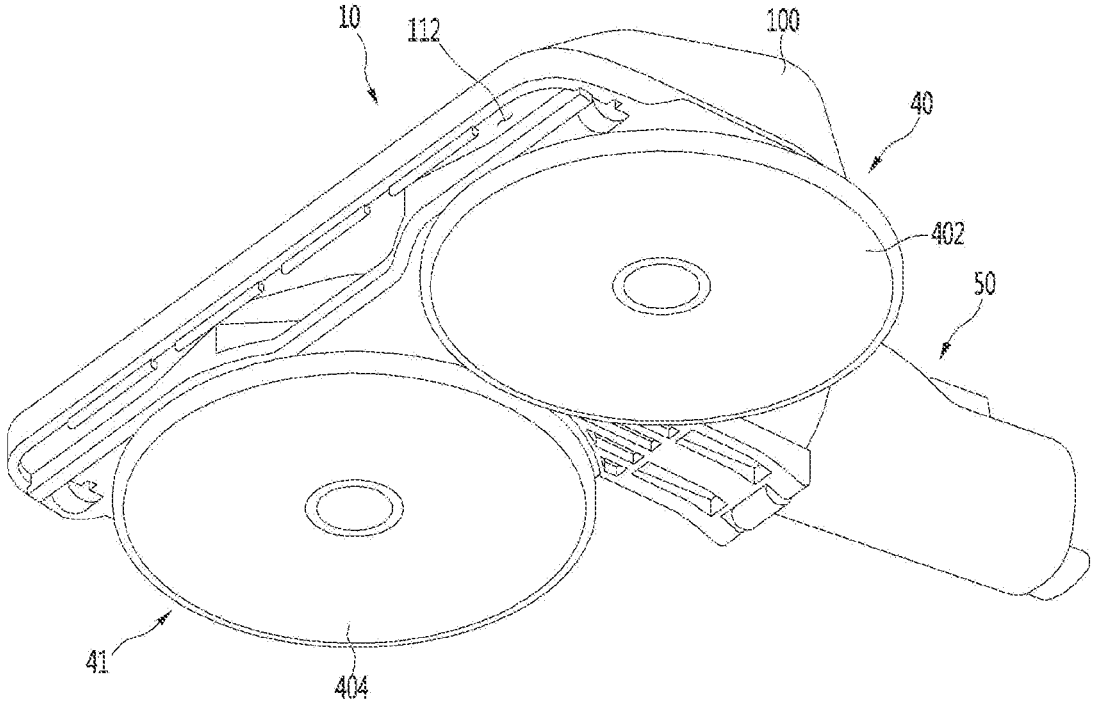
Figure 3:
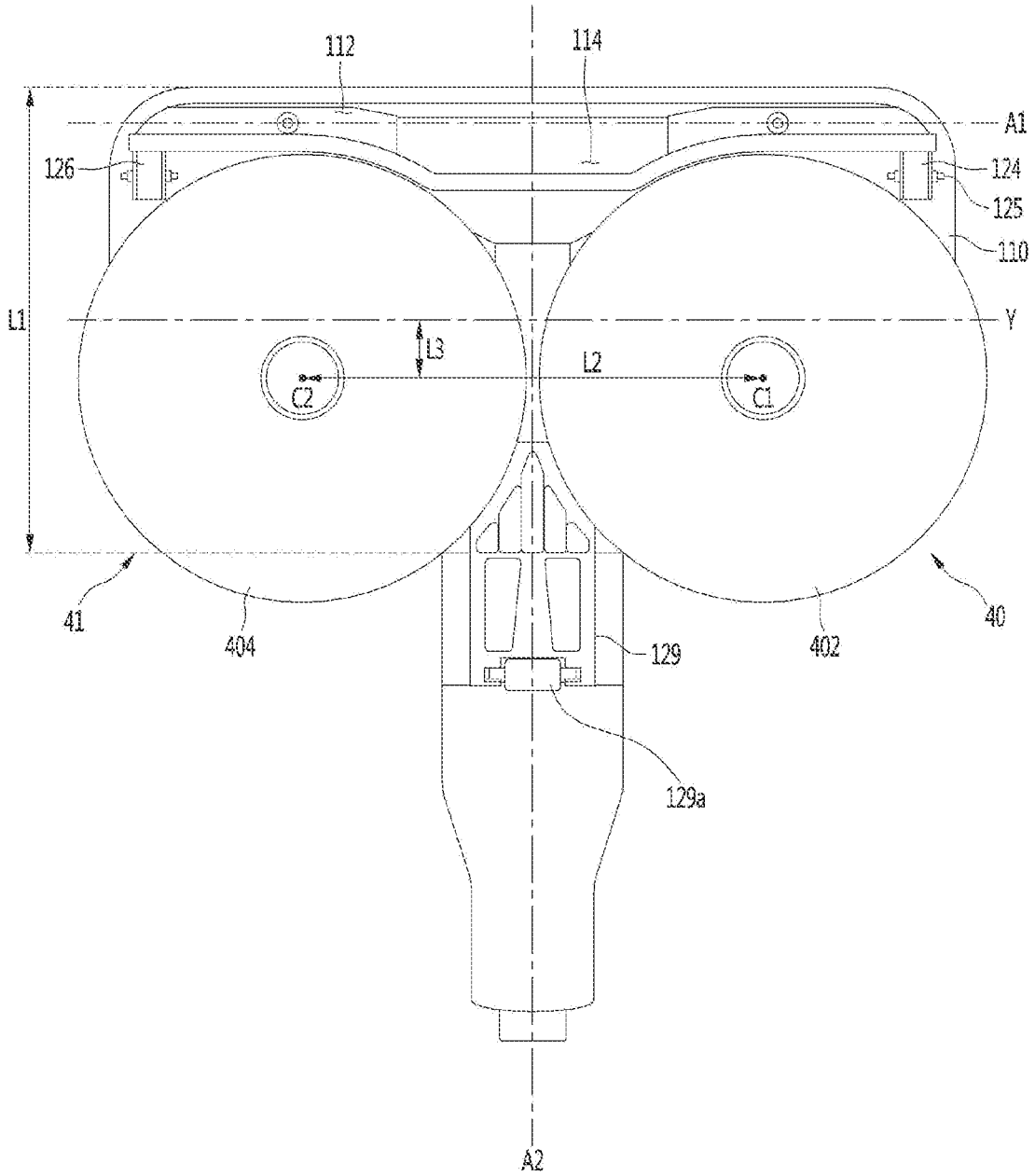
FIG. 3 is a bottom view illustrating a nozzle of a cleaner according to an embodiment of the present disclosure.
Figure 4:
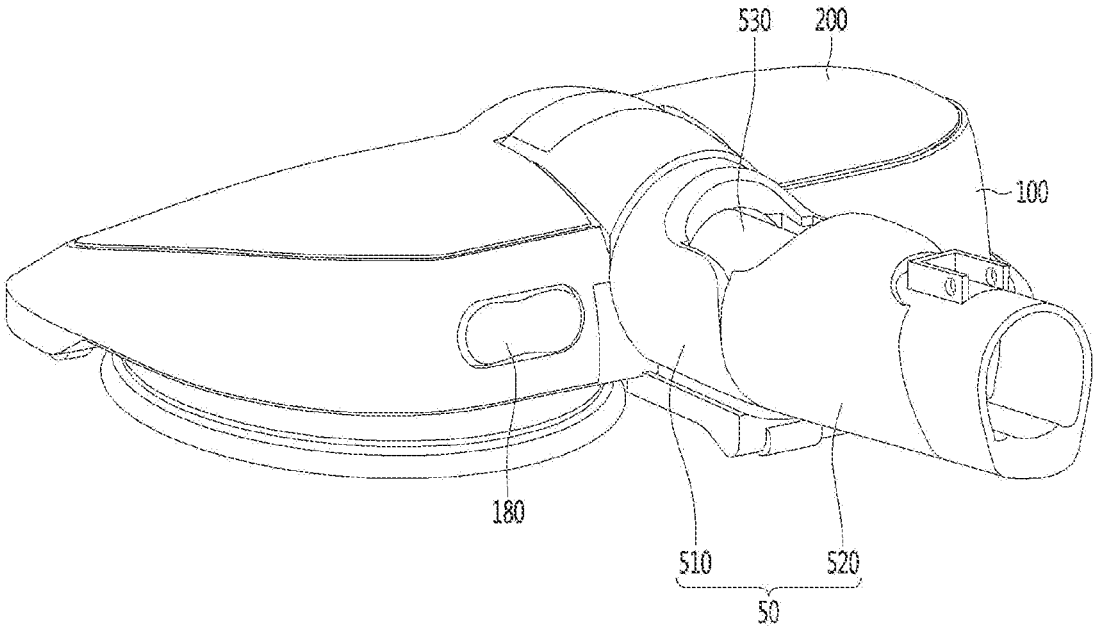
FIG. 4 is a perspective view illustrating the nozzle of the cleaner of FIG. 1 viewed from the rear side.
Figure 5:
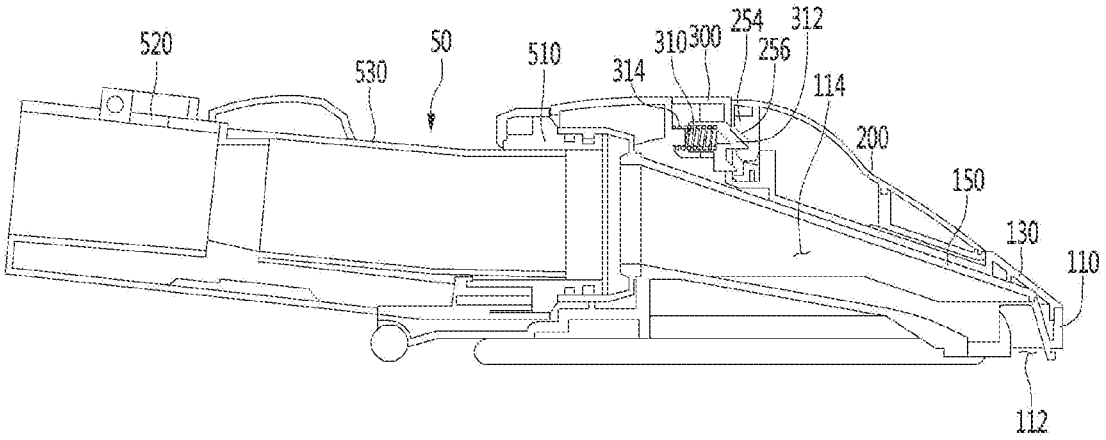
FIG. 5 is a sectional view taken along line A-A of FIG. 1.

FIG. 1 and FIG. 2 are perspective views illustrating a nozzle of a cleaner according to an embodiment of the present disclosure, FIG. 3 is a bottom view illustrating a nozzle of a cleaner according to an embodiment of the present disclosure, FIG. 4 is a perspective view illustrating the nozzle of the cleaner of FIG. 1 viewed from the rear side, and FIG. 5 is a sectional view taken along line A-A of FIG. 1.

Referring to FIG. 1 to FIG. 5, a nozzle 1 of a cleaner (hereinafter referred to as "nozzle") according to an embodiment of the present disclosure includes a nozzle main body 10, and a connection tube 50 which is connected to the nozzle main body 10 so as to be capable of moving.

The nozzle 1 of the present embodiment can be used, for example, in a state of being connected to a handy type cleaner or connected to a canister type cleaner.

The nozzle 1 itself has a battery to supply power to the power consumption unit therein, or can be operated by receiving power from the cleaner.

Since the cleaner to which the nozzle 1 is connected includes a suction motor, a suction force generated by the suction motor applies to the nozzle 1 to be capable of suctioning foreign matter and air on the floor at the nozzle 1.

Accordingly, in the present embodiment, the nozzle 1 can perform a function of suctioning foreign matter and air on the bottom surface and guiding the foreign matter and air to the cleaner.

Although not limited thereto, the connection tube 50 is connected to the rear central portion of the nozzle main body 10 to guide the suctioned air to the cleaner.

The nozzle 1 may further include rotation cleaning units 40 and 41 rotatably disposed below the nozzle main body 10.

For example, a pair of rotation cleaning units 40 and 41 may be arranged in the lateral direction. The pair of rotation cleaning units 40 and 41 can be independently rotated. For example, the nozzle 1 may include a first rotation cleaning unit 40 and a second rotation cleaning unit 41.

Each of the rotation cleaning units 40 and 41 may include mops 402 and 404. The mops 402 and 404 may be formed in a disc shape, for example. The mops 402 and 402 may include a first mop 402 and a second mop 404.

The nozzle main body 10 may include a nozzle housing 100 forming an outer shape. The nozzle housing 100 may include a suction flow path 112 and 114 for suctioning air.

The suction flow path 112 and 114 includes a first flow path 112 extending in the lateral direction in the nozzle housing 100 and a second flow path 114 communicating with the first flow path 112 and extending in the front and rear direction.

The first flow path 112 may be formed at a front end portion of the lower surface of the nozzle housing 100, as an example.

The second flow path 114 may extend rearward from the first flow path 112. For example, the second flow path 114 may extend rearward from the central portion of the first flow path 112 toward the connection tube 50.

Accordingly, a centerline A1 of the first flow path 112 can extend in the lateral horizontal direction. A centerline A2 of the second flow path 114 can extend in the front and rear direction and can intersect the centerline A1 of the first flow path 112.

The centerline A2 of the second flow path 114 may be positioned at a position where the nozzle main body 10 is bisected right and left, as an example.

A portion of the mops 402 and 404 is protruded to the outside of the nozzle 1 in a state where the rotation cleaning units 40 and 41 are connected to the lower side of the nozzle main body 10 and thus the rotation cleaning units 40 and 41 can clean not only a floor positioned directly below the nozzle but also the floor positioned outside the nozzle 1.

For example, the mops 402 and 404 may protrude not only to both sides of the nozzle 1 but also to the rear of the nozzle 1.

The rotation cleaning units 40 and 41 may be positioned on the rear side of the first flow path 112 from below the nozzle main body 10, for example.

Therefore, when the nozzle 1 is advanced and cleaned, the floor can be cleaned by the mops 402, 404 after foreign substances and air on the floor are suctioned by the first flow path 112.

In the present embodiment, the first rotation center C1 of the first rotation cleaning unit 40 (for example, rotation center of rotation plate 420) and the second rotation center C2 of the second rotation cleaning unit 41 (for example, rotation center of rotation plate 440) are disposed in a state of being spaced apart from each other in the lateral direction.

The centerline A2 of the second flow path 114 may be positioned in a region between the first rotation center C1 and the second rotation center C2.

The central axis Y bisecting the front and rear length L1 of the nozzle main body 10 (excluding the extension portion) may be positioned in front of the rotation centers C1 and C2 of each of the rotation cleaning units 40 and 41. That is, the central axis Y bisecting the front and rear length L1 of the nozzle main body 10 may be positioned closer to the front end of the nozzle main body 10 than the rotation centers C1 and C2 of each of the rotation cleaning units 40 and 41. This is for preventing the rotation cleaning units 40 and 41 from blocking the first flow path 114.

Therefore, the distance L3 between the central axis Y and the rotation centers C1 and C2 of the rotation cleaning units 40 and 41 may be set to a value greater than zero.

In addition, the distance L2 between the rotation centers C1 and C2 of the rotation cleaning units 40 and 41 may be greater than the diameter of each of the mops 402 and 404. This is for preventing the mops 402 and 404 from interfering in the process of being rotated, reducing mutual friction, and reducing the area that can be cleaned as much as the interfering portions.

Although not limited, the diameters of the mops 402 and 404 are preferably 0.6 times or more than half the left and right widths of the nozzle main body 10. In this case, the area in which the mops 402 and 404 can clean the floor facing the nozzle main body 10 increases, and the area in which the mops 402 and 404 can clean the floor not facing the nozzle main body 10 increases. In addition, when cleaning using the nozzle 1, the cleaning area by the mops 402 and 404 may be secured even with a small amount of movement.

The nozzle housing 100 may include a nozzle base 110 and a nozzle cover 130 coupled to the upper side of the nozzle base 110.

The nozzle base 110 may form the first flow path 112. The nozzle housing 100 may further include a flow path forming portion 150 forming the second flow path 114 together with the nozzle base 110.

The flow path forming portion 150 may be coupled to the upper central portion of the nozzle base 110 and the end portion of the flow path forming portion 150 may be connected to the connection tube 50.

Accordingly, by disposing the flow path forming portion 150, the second flow path 114 can extend substantially straight forward and backward, so the length of the second flow path 114 can be minimized, whereby a loss of flow path in the nozzle 1 can be minimized.

The front portion of the flow path forming portion 150 may cover the upper side of the first flow path 112. The flow path forming portion 150 may be disposed to be inclined upward from the front end portion toward the rear side.

Therefore, the height of the front portion of the flow path forming portion 150 may be lower than that of the rear portion of the flow path forming portion 150.

According to the present embodiment, since the height of the front portion of the flow path forming portion 150 is low, there is an advantage that the height of the front portion of the entire height of the nozzle 1 can be reduced. The lower the height of the nozzle 1, the more likely it is that the nozzle 1 can be drawn into a narrow space on the lower side of furniture or a chair to be cleaned.

The nozzle base 110 may include an extension portion 129 for supporting the connection tube 50. The extension portion 129 may extend rearward from the rear end of the nozzle base 110.

The connection tube 50 may include a first connection tube 510 connected to an end of the flow path forming portion 150, a second connection tube 520 rotatably connected to the first connection tube 510, and a guide tube 530 for communicating the first connection tube 510 with the second connection tube 520.

The first connection tube 510 may be seated on the extension portion 129 and the second connection tube 520 may be connected to an extension tube or hose of the cleaner.

A plurality of rollers for smooth movement of the nozzle 1 may be provided on the lower side of the nozzle base 110.

For example, the first roller 124 and the second roller 126 may be positioned behind the first flow path 112 on the nozzle base 110. The first roller 124 and the second roller 126 may be spaced apart from each other in the lateral direction.

According to the present embodiment, the first roller 124 and the second roller 126 are disposed behind the first flow path 112 so that the first flow path 112 can be positioned as close as possible to the front end portion of the nozzle base 110 and thus the area which can be cleaned by using the nozzle 1 can be increased.

As the distance from the front end portion of the nozzle base 110 to the first flow path 112 increases, the area in which the suction force does not apply in front of the first flow path 112 during the cleaning process increases, and thus the area where the cleaning is not performed is increased.

On the other hand, according to the present embodiment, the distance from the front end portion of the nozzle base 110 to the first flow path 112 can be minimized, and thus the cleanable area can be increased.

In addition, by disposing the first roller 124 and the second roller 126 behind the first flow path 112, the length of the first flow path 112 in the lateral direction can be maximized.

In other words, the distance between both end portions of the first flow path 112 and both end portions of the nozzle base 110 can be minimized.

In the present embodiment, the first roller 124 may be positioned in a space between the first flow path 112 and the first mop 402. The second roller 126 may be positioned in a space between the first flow path 112 and the second mop 404.

The first roller 124 and the second roller 126 may be rotatably connected to a shaft 125, respectively. The shaft 125 may be fixed to the lower side of the nozzle base 110 in a state of being disposed so as to extend in the lateral direction.

The distance between the shaft 125 and the front end portion of the nozzle base 110 is longer than the distance between the front end portion of the nozzle base 110 and each of the mops 402 and 404 (or a rotation plate described later).

For example, at least a portion of each of the rotation cleaning units 40 and 41 (mop and/or rotation plate) can be positioned between the shaft 125 of the first roller 124 and the shaft 125 of the second roller 126.

According to this disposition, the rotation cleaning units 40 and 41 can be positioned as close as possible to the first flow path 112, and the area to be cleaned by the rotation cleaning units 40 and 41 of the floor on which the nozzles 1 are positioned can be increased, and thus the floor cleaning performance can be improved.

The plurality of rollers are not limited, but the nozzle 1 can be supported at three points. In other words, the plurality of rollers may further include a third roller 129*a* provided on the extension portion 129 of the nozzle base 110.

The third roller 129*a* may be positioned behind the mop 402, 404 to prevent interference with the mop 402, 404.

Meanwhile, the nozzle main body 10 may further include a water tank 200 to supply water to the mops 402 and 404.

The water tank 200 may be detachably connected to the nozzle housing 100. The water in the water tank 200 can be supplied to each of the mops 402 and 404 in a state where the water tank 200 is mounted on the nozzle housing 100.

The nozzle main body 10 may further include an operating unit 300 that operates to separate the water tank 200 in a state where the water tank 200 is mounted on the nozzle housing 100.

The operating unit 300 may be provided in the nozzle housing 100 as an example. The nozzle housing 100 may be provided with a first coupling unit 310 for coupling with the water tank 200 and the water tank 200 may be provided with a second coupling unit 254 for coupling with the first coupling unit 310.

The operating unit 300 may be disposed so as to be capable of vertically moving in the nozzle housing 100. The first coupling unit 310 can be moved under the operation force of the operating unit 300 at the lower side of the operating unit 300.

For example, the first coupling unit 310 may move in the front and rear direction. For this purpose, the operating unit 300 and the first coupling unit 310 may include inclined surfaces contacting each other.

When the operating unit 300 is lowered by the inclined surfaces, the first coupling unit 310 can move horizontally (for example, moving in the front and rear direction).

The first coupling unit 310 includes a hook 312 for engaging with the second coupling unit 254 and the second coupling unit 254 includes a groove 256 for inserting the hook 312.

The first coupling unit 310 may be resiliently supported by an elastic member 314 so as to maintain a state where the first coupling unit 310 is coupled to the second coupling unit 254.

Therefore, due to the elastic member 314, the hook 312 is inserted into the groove 256. When the operating unit 300 is pressed downward, the hook 312 is removed from the groove 256. When the hook 312 is removed from the groove 256, the water tank 200 may be separated from the nozzle housing 100.

In the present embodiment, the operating unit 300 may be positioned directly above the second flow path 114, for example. For example, the operating unit 300 may be disposed to overlap the centerline A2 of the second flow path 114 in the vertical direction.

Meanwhile, the nozzle main body 10 may further include an adjusting unit 180 for adjusting the amount of water discharged from the water tank 200. For example, the adjusting unit 180 may be positioned on the rear side of the nozzle main body 10.

The adjusting unit 180 can be operated by a user and the adjusting unit 180 can allow the water being discharged from the water tank 200 or prevent the water from being discharged.

Alternatively, the amount of water discharged from the water tank 200 can be adjusted by the adjusting unit 180. For example, when the adjusting unit 180 is operated, water is discharged from the water tank 200 by a first amount per unit time, or water is discharged by a second amount greater than the first amount per unit time.

The adjusting unit 180 may be provided to pivot in the left and right direction on the nozzle main body 10, or may be provided to pivot in the vertical direction.

For example, when the adjusting unit 180 is positioned in the neutral position as illustrated in FIG. 4, the amount of water discharged is 0, and when the left side of the adjusting unit 180 is pushed so that the adjusting unit 180 pivots to the left, water may be discharged from the water tank 200 by a first amount per unit time.

When the right side of the adjusting unit 180 is pushed so that the adjusting unit 180 pivots to the right, water may be discharged from the water tank 200 by a second amount per unit time. The configuration for detecting the operation of the adjusting unit 180 will be described later with reference to the drawings.

Figure 6:
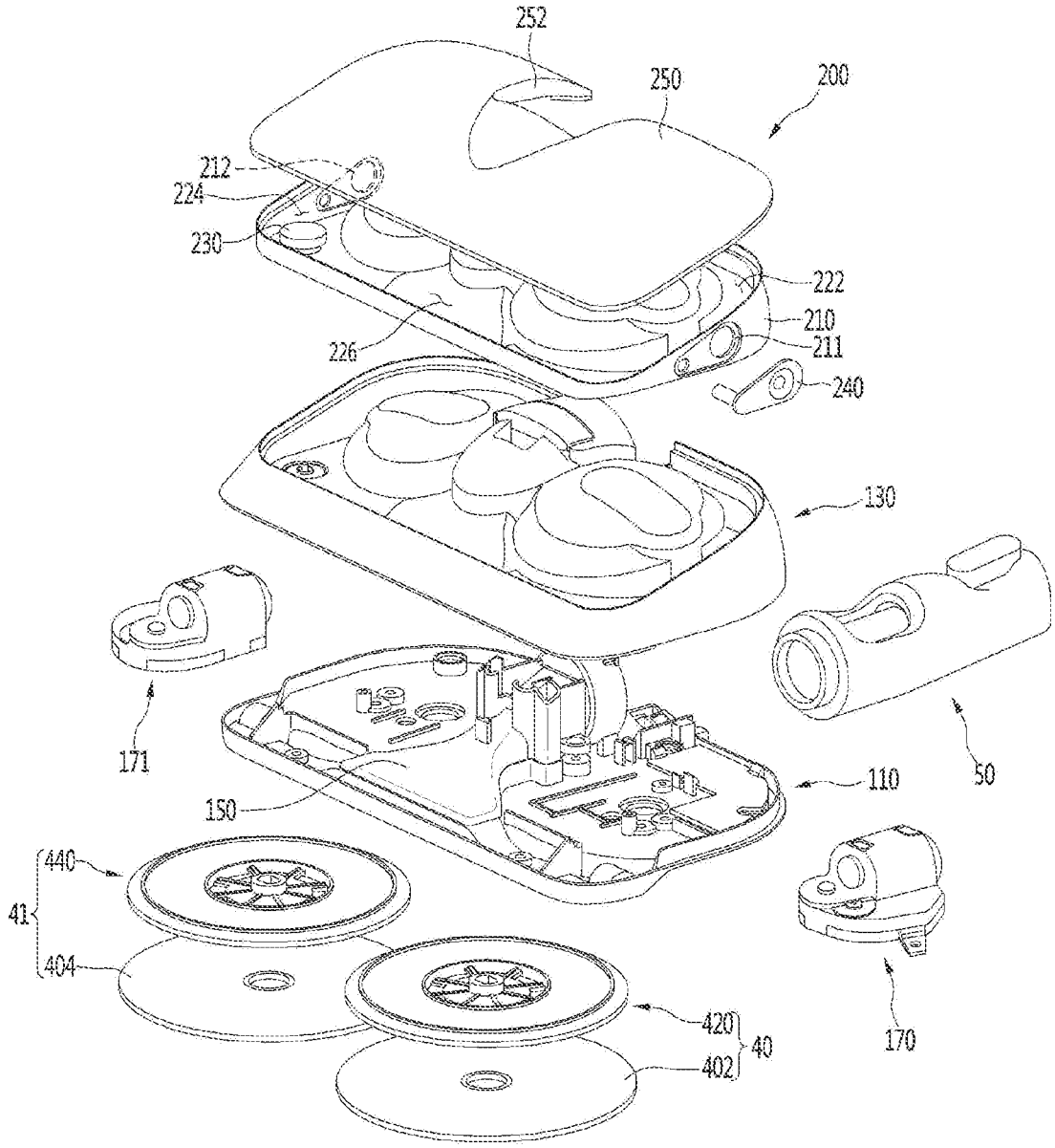
FIG. 6 and FIG. 7 are exploded perspective views of a nozzle according to an embodiment of the present disclosure.
Figure 7:
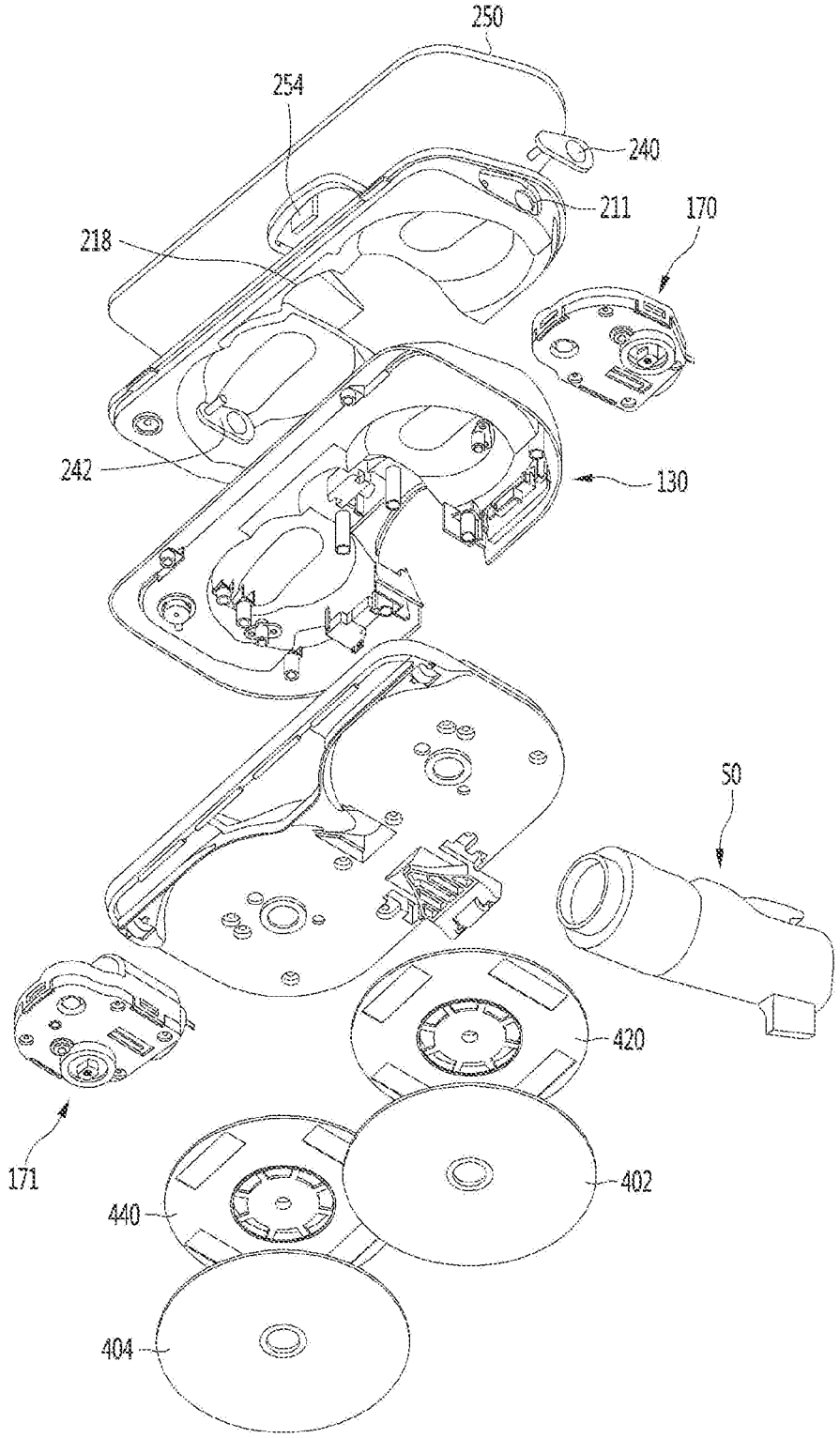
Figure 8:
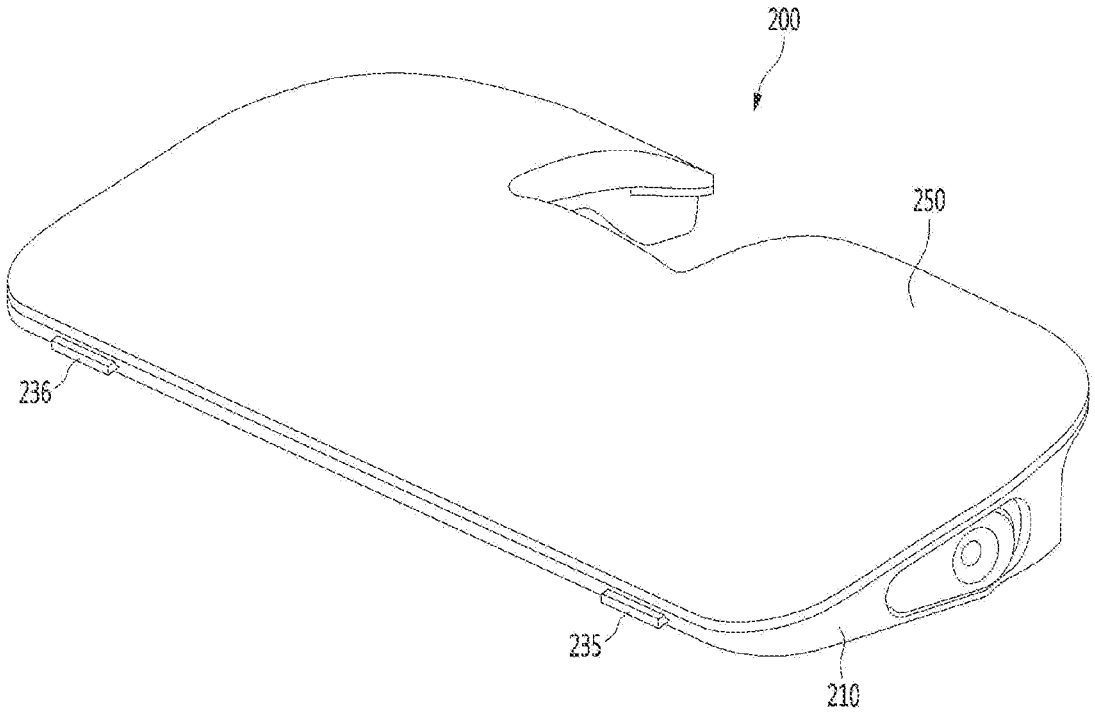
FIG. 8 and FIG. 9 are perspective views of a water tank according to an embodiment of the present disclosure.
Figure 9:
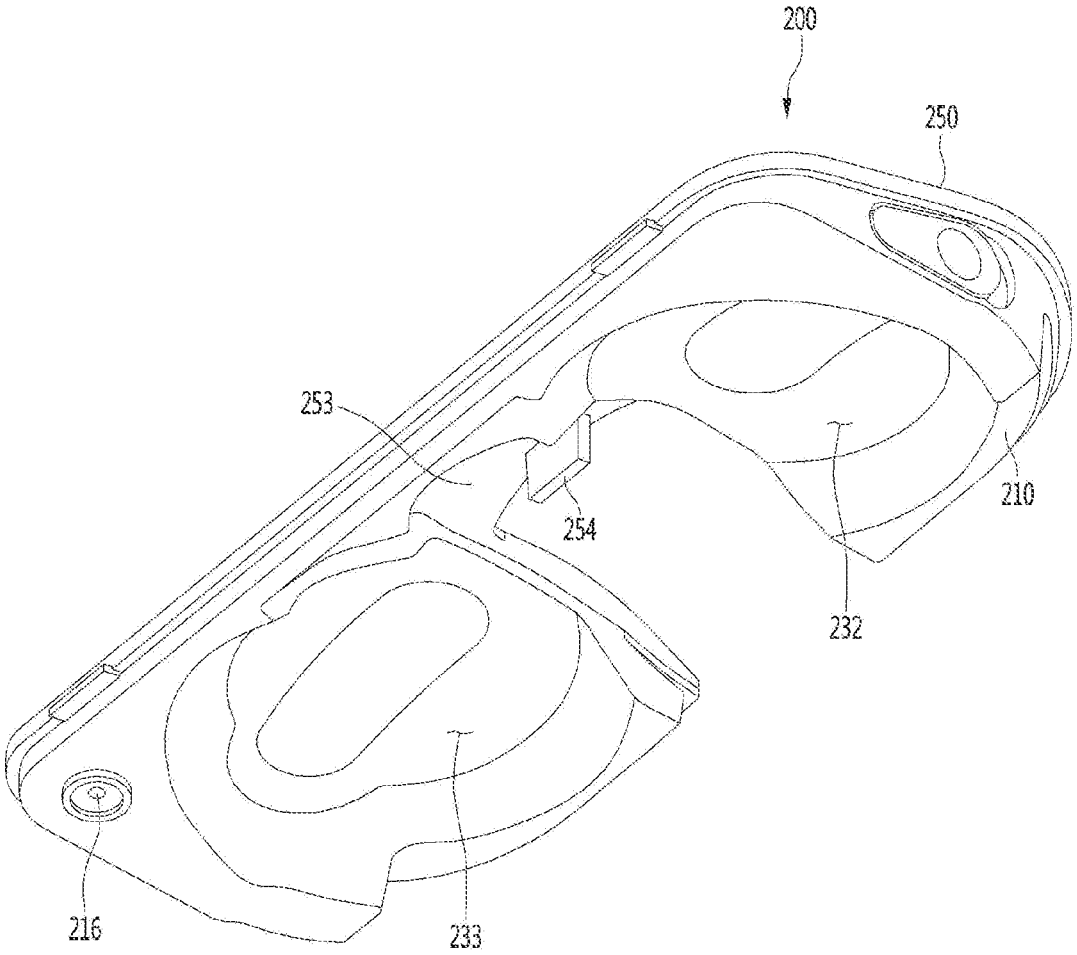

FIG. 6 and FIG. 7 are exploded perspective views of a nozzle according to an embodiment of the present disclosure, and FIG. 8 and FIG. 9 are perspective views of a water tank according to an embodiment of the present disclosure.

FIG. 3 and FIG. 6 to FIG. 9, the nozzle main body 10 may further include a plurality of driving devices 170 and 171 for individually driving the respective rotation cleaning units 40 and 41.

The plurality of driving devices 170 and 171 may include a first driving device 170 for driving the first rotation cleaning unit 40 and a second driving device 171 for driving the second rotation cleaning unit 41.

Since each of the driving devices 170 and 171 operates individually, even if some of the driving devices 170 and 171 fail, there is an advantage that some of the rotation cleaning devices can be rotated by another driving device.

The first driving device 170 and the second driving device 171 may be spaced apart from each other in the lateral direction in the nozzle main body 10.

The driving devices 170 and 171 may be positioned behind the first flow path 112.

For example, at least a portion of the second flow path 114 may be positioned between the first driving device 170 and the second driving device 171. Therefore, even if the plurality of driving devices 170 and 171 are provided, the second flow path 114 is not affected, and thus the length of the second flow path 114 can be minimized.

According to the present embodiment, since the first driving device 170 and the second driving device 171 are disposed on both sides of the second flow path 114, the weight of the driving devices 170, 171 in the nozzle 1 can be uniformly distributed to the left and right so that it is possible to prevent the center of gravity of the nozzle 1 from being biased toward any one side of the nozzle 1.

The plurality of driving devices 170 and 171 may be disposed in the nozzle main body 10. For example, the plurality of driving devices 170 and 171 may be seated on the upper side of the nozzle base 110 and covered with the nozzle cover 130. That is, the plurality of driving devices 170 and 171 may be positioned between the nozzle base 110 and the nozzle cover 130.

Each of the rotation cleaning units 40 and 41 may further include rotation plates 420 and 440 which are rotated by receiving power from each of the driving devices 170 and 171.

The rotation plates 420 and 440 may include a first rotation plate 420 which is connected to the first driving device 170 and to which the first mop 402 is attached and a second rotation plate 420 which is connected to the second driving device 171 and a second rotation plate 440 to which the second mop 404 is attached.

The rotation plates 420 and 440 may be formed in a disc shape, and the mops 402 and 404 may be attached to the bottom surface of the rotation plates 420 and 440.

The rotation plates 420 and 440 may be respectively connected to the driving devices 170 and 171 from the lower side of the nozzle base 110. That is, the rotation plates 420 and 440 may be connected to the driving devices 170 and 171 outside the nozzle housing 100.

<Water Tank>

The water tank 200 may be mounted on the upper side of the nozzle housing 100. For example, the water tank 200 may be seated on the nozzle cover 130. The water tank 200 can form a portion of an appearance of the upper surface of the nozzle main body 10 in a state where the water tank 200 is seated on the upper side of the nozzle cover 130. For example, the water tank 200 may form a part of the upper appearance of the nozzle main body 10.

The water tank 200 may include a first body 210, and a second body 250 coupled to the first body 210 and defining a chamber in which water is stored together with the first body 210.

The chamber may include a first chamber 222 positioned above the first driving device 170, a second chamber 224 positioned above the second driving device 171, and a connection chamber 226 communicating the first chamber 222 with the second chamber 224 and positioned above the second flow path 114.

In the present embodiment, the volume of the connection chamber 226 may be formed to be smaller than the volume of the first chamber 222 and the second chamber 24 so that the amount of water to be stored is increased while minimizing the height of the nozzle 1 by the water tank 200.

The water tank 200 may be formed so that the front height is low and the rear height is high. For example, the connection chamber 226 may connect the first chamber 222 and the second chamber 224 disposed at both sides in the front portion of the water tank 200. That is, the connection chamber 226 may be positioned in the front portion of the water tank 200.

The water tank 200 may have a first inlet 211 for introducing water into the first chamber 222 and a second inlet 212 for introducing water into the second chamber 224.

The first inlet 211 may be covered by a first inlet cover 240 and the second inlet 212 may be covered by a second inlet cover 242. For example, each inlet cover 240 and 242 may be formed of a rubber material.

The first and second inlets 211, 212 may be provided in the first body 210, for example.

The heights of both sides of the first body 210 may be the smallest at the front ends and may increase toward the rear ends.

In order to secure the sizes of the inlets 211 and 212, the inlets 211 and 212 may be positioned closer to the rear end than the front end of the first body 210.

The first body 210 may include a first slot 218 for preventing interference with the operating unit 300 and the coupling units 310 and 254. The first slot 218 may be formed such that the central rear end of the first body 210 is recessed toward the front.

The second body 250 may include a second slot 252 for preventing interference with the operating unit 300. The second slot 252 may be formed such that the central rear end of the second body 230 is recessed forward.

The second body 250 may further include a slot cover 253 covering a portion of the first slot 218 of the first body 210 in a state of being coupled to the first body 210. That is, the front and rear length of the second slot 252 is formed to be shorter than the front and rear length of the first slot 218.

The second coupling unit 254 may extend downward from the slot cover 253. Accordingly, the second coupling unit 254 may be positioned within a space formed by the first slot 218.

The water tank 200 may further include a coupling rib 235 and 236 for coupling with the nozzle cover 130 before the second coupling unit 254 of the water tank 200 is coupled with the first coupling unit 310.

The coupling ribs 235 and 236 also performs a role which guides the coupling position of the water tank 200 in the nozzle cover 130 before the second coupling unit 254 of the water tank 200 is coupled with the first coupling unit 310.

For example, a plurality of coupling ribs 235 and 236 protrude from the first body 110 and may be disposed so as to be spaced apart in the left and rear horizontal direction.

Though not limited, the plurality of coupling ribs 235 and 236 may protrude forward from a front surface of the first body 210 and may be spaced apart from each other in the lateral direction.

Since each of the driving devices 170 and 171 is provided in the nozzle main body 10, a portion of the nozzle main body 10 may protrude upward at both sides of the second flow path 114 by each of the driving devices 170 and 171.

The water tank 200 may have a pair of receiving spaces 232 and 233 to prevent interference with the portions protruding from the nozzle main body 10. The pair of receiving spaces 232 and 233, for example, may be formed as a portion of the first body 210 is recessed upward. The pair of receiving spaces 232 and 233 may be divided into right and left by the first slot 218.

The water tank 200 may further comprise a discharge port 216 for discharging water from the water tank 200.

The discharge port 216 may be formed on, for example, the lower surface of the first body 210. The discharge port 216 may be opened or closed by a valve 230. The valve 230 may be disposed in the water tank 200.

In the present embodiment, the discharge port 216 may be positioned under any one of the first chamber 222 and the second chamber 224. That is, the water tank 200 may have a single discharge port 216.

The reason that the water tank 200 has the single discharge port 216 is for reducing the number of portions where water can leak.

That is, since there are components (control boards, driving motors, etc.) that operate by receiving power in the nozzle 1, these components have to be completely blocked from the contact with water. In order to block the contact between the components and water, it is necessary to basically block water leakage from the portion of the water tank 200 where water is discharged.

As the number of discharge ports 216 in the water tank 200 increases, a structure for preventing water leakage is additionally required, and thus, the structure becomes complicated. Even when there is a structure for preventing water leakage, there is a possibility that leakage cannot be completely prevented.

In addition, as the number of discharge ports 216 in the water tank 200 increases, the number of valves 230 for opening or closing the discharge ports 216 also increases. This means that not only the number of components is increased, but also the volume of the chamber for storing water in the water tank 200 is reduced by the valve 230.

Since the height of the water tank 200 is larger at the rear than the front of the water tank 200, the discharge port 216 may be positioned close to the front end of the first body 210 so that the water in the water tank 200 can be smoothly discharged.

<Nozzle Cover>

Figure 10:
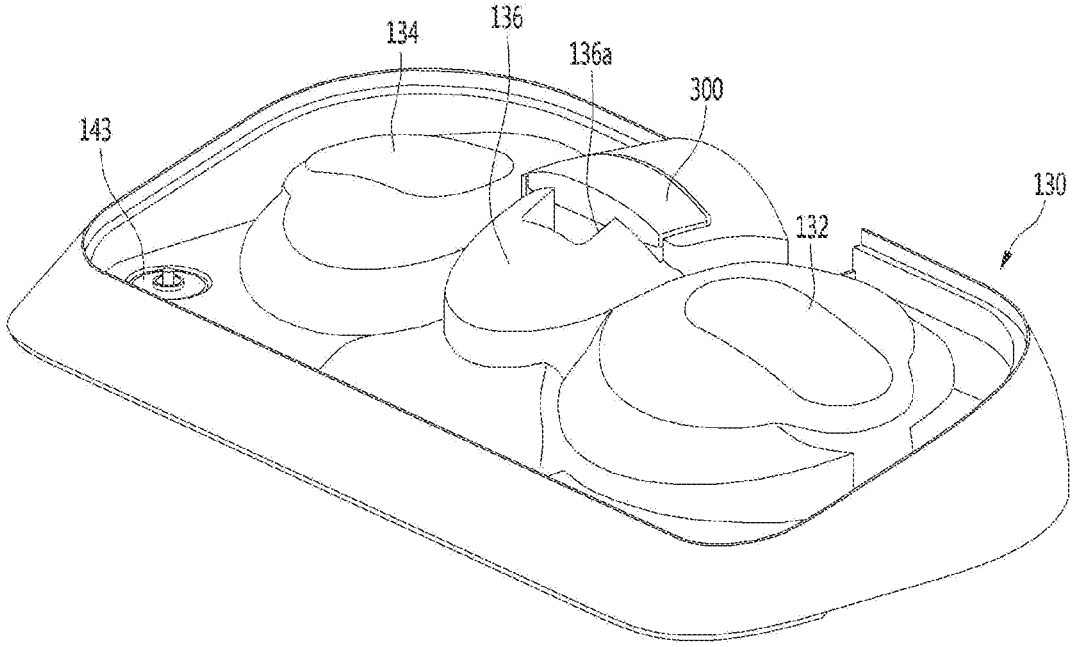
FIG. 10 is a perspective view illustrating a nozzle cover according to an embodiment of the present disclosure as viewed from above.
Figure 11:
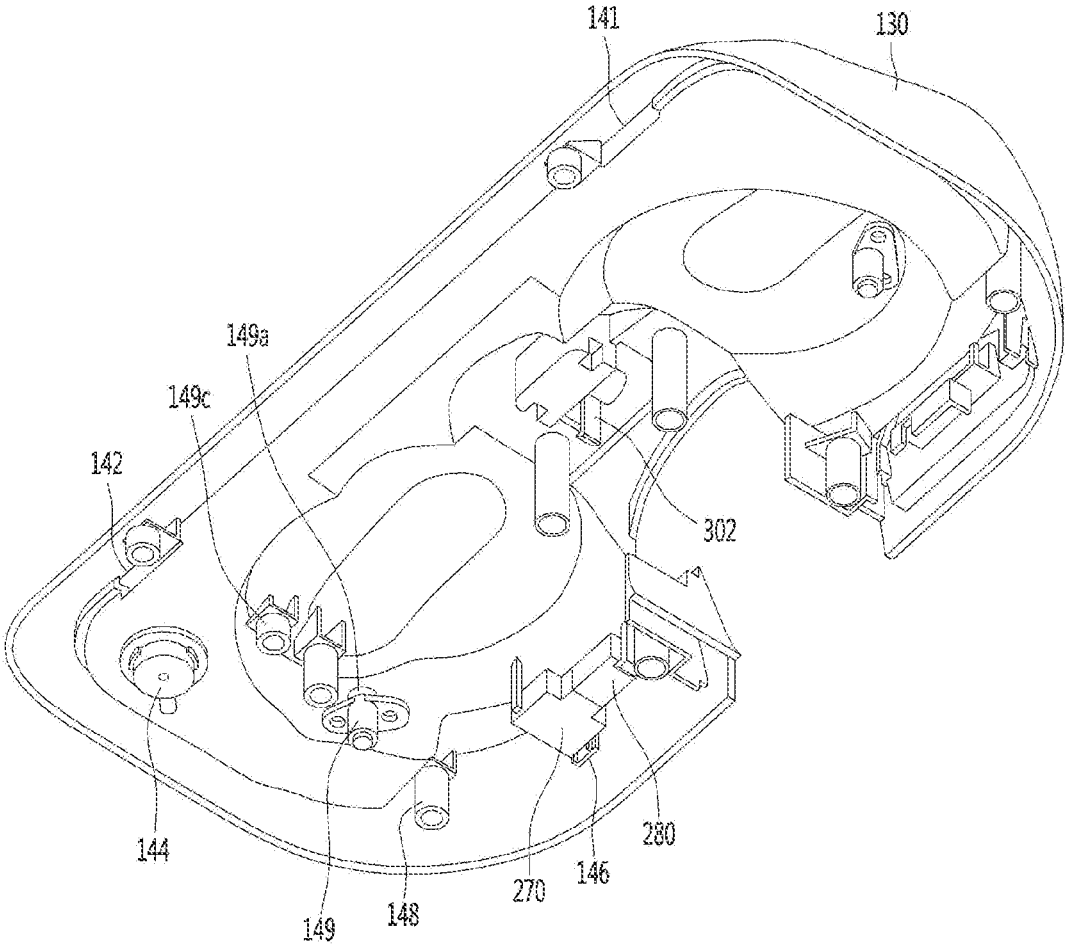
FIG. 11 is a perspective view illustrating a nozzle cover according to an embodiment of the present disclosure as viewed from below.

FIG. 10 is a perspective view illustrating a nozzle cover according to an embodiment of the present disclosure as viewed from above, and FIG. 11 is a perspective view illustrating a nozzle cover according to an embodiment of the present disclosure as viewed from below.

Figure 15:
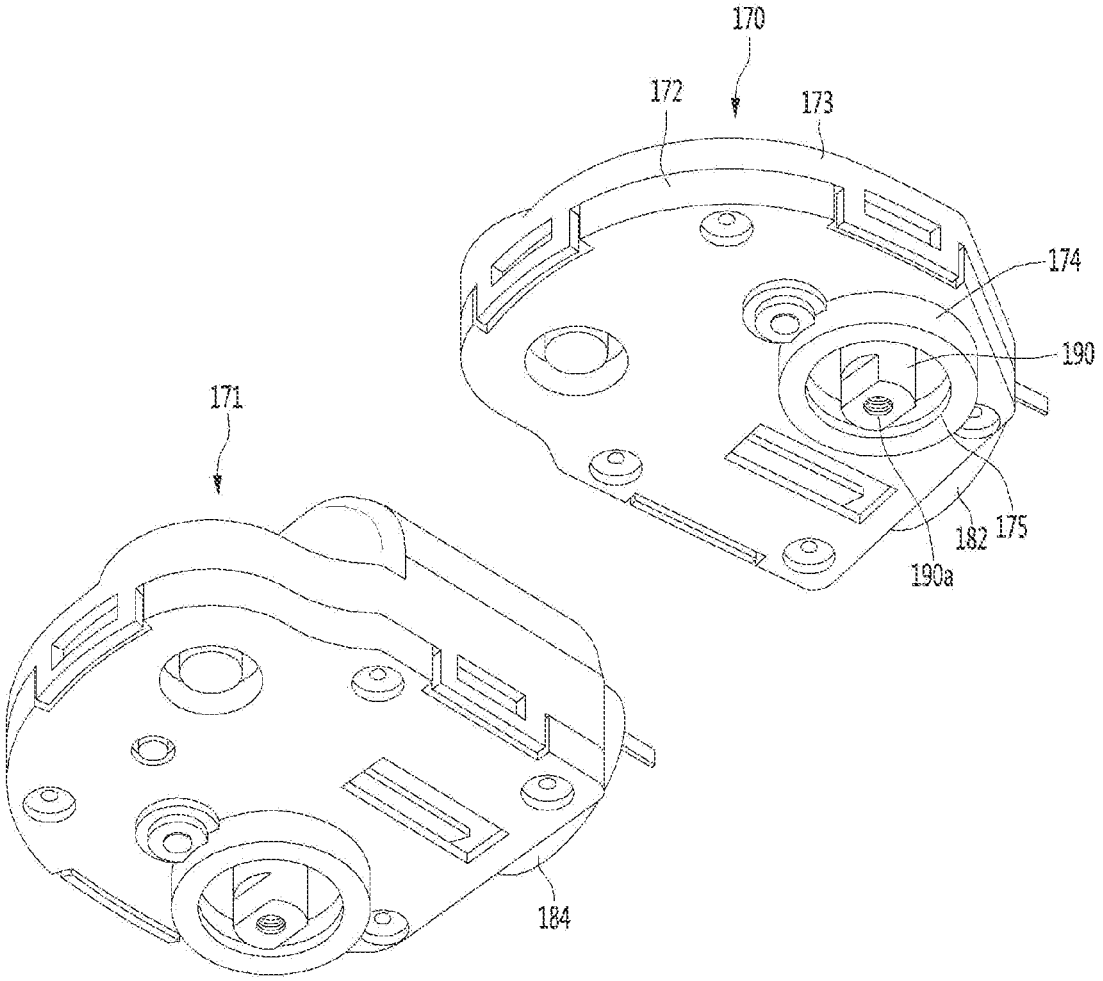
FIG. 15 is a view illustrating first and second driving devices according to an embodiment of the present disclosure as viewed from below.

Referring to FIG. 6, FIG. 10 and FIG. 15, the nozzle cover 130 may include driving unit covers 132 and 134 that cover the upper side of each of the driving devices 170 and 171.

Each of the driving unit covers 132 and 134 is a portion which protrudes upward from the nozzle cover 130. Each of the driving unit covers 132 and 134 may surround the upper side of the driving devices 170 and 171 without interfering with the driving devices 170 and 171 installed in the nozzle base 110.

When the water tank 200 is seated on the nozzle cover 130, each of the driving unit cover 132 and 134 is received in each of the receiving spaces 232 and 233 of the water tank 200, and thus interference between the components is prevented.

In addition, in the water tank 200, the first chamber 222 and the second chamber 224 may be disposed so as to surround the periphery of each of the respective driving unit covers 132 and 134.

Thus, according to the present embodiment, the volumes of the first chamber 222 and the second chamber 224 can be increased.

The first body 210 of the water tank 200 may be seated in a portion lower than the driving unit covers 132 and 134 in the nozzle cover 130.

At least a portion of the bottom wall of the water tank 200 may be positioned lower than the axis of the driving motor A3 and A4 to be described later. For example, the bottom wall the first and second chambers may be positioned lower than the axis of the driving motor A3 and A4.

The nozzle cover 130 may further include a flow path cover 136 covering the flow path forming portion 150. The flow path cover 136 may be positioned between the driving unit covers 132 and 134, and may be disposed at a position corresponding to the first slot 218 of the water tank 200.

The flow path cover 136 can support the operating unit 300. The operating unit 300 may include a coupling hook 302 for coupling to the flow path cover 135. The operating unit 300 may be coupled to the flow path cover 136 from the upper side of the flow path cover 136.

When the coupling hook 302 is coupled to the flow path cover 136, the operating unit 300 can be prevented from separating upward from the flow path cover 136.

An opening 136*a* through which the second coupling unit 254 can be inserted may be formed at the flow path cover 136. The first coupling unit 310 may be coupled to the second coupling unit 254 when the second coupling unit 254 of the water tank 200 is inserted into the opening 136*a*.

The flow path cover 136 may be positioned in the first slot 218 of the first body 210 and the second slot 252 of the second body 250. In the present embodiment, so as to increase the water storage capacity of the water tank 200, a portion of the water tank 200 may be positioned on both sides of the flow path cover 136. Therefore, the capacity of the water tank 200 can be increased while the water tank 200 is prevented from interfering with the second flow path 114.

In addition, the highest point of the water tank 200 may be positioned equal to or lower than the highest point of the flow path cover 136 so as to prevent an increase in height by the water tank 200.

In addition, the entire water tank 200 may be disposed to overlap the nozzle housing 100 in the vertical direction, so that the water tank 200 is prevented from colliding with the surrounding structures of the nozzle 1 in the process of moving the nozzle 1. That is, the water tank 200 does not protrude in the left and right direction of the nozzle housing 100.

The nozzle cover 130 may further include rib insertion holes 141 and 142 into which the coupling ribs 235 and 236 provided in the water tank 200 are inserted.

Accordingly, a center portion of the water tank 200 is moved downward in a state where the coupling ribs 235 and 236 are inserted into the rib insertion holes 141 and 142, and thus the second coupling unit 254 may be coupled to the first coupling unit 310.

The nozzle cover 130 may be provided with a valve operating unit 144 for operating the valve 230 in the water tank 200 and allowing water to flow. The valve operating unit 144 may be coupled to the nozzle cover 130. The valve operating unit 144 may be coupled to the lower side of the nozzle cover 130, and a portion of the valve operating unit 144 may protrude upward through the nozzle cover 130. When the water tank 200 is mounted on the nozzle housing 100, the valve operating unit 144 protruding upward may pass through the discharge port 216 of the water tank 200 and flow into the water tank 200.

The valve operating unit 144 will be described later.

The nozzle cover 130 may be provided with a sealer 143 for preventing water discharged from the water tank 200 from leaking from the vicinity of the valve operating unit 144.

The nozzle cover 130 may be provided with a water pump 270 for controlling water discharged from the water tank 200. The water pump 270 may be connected to a pump motor 280.

A pump installation rib 146 for installing the water pump 270 may be provided on the lower side of the nozzle cover 130.

The water pump 270 is a pump that operates so as to communicate the inlet and the outlet by expanding or contracting the valve body therein while being operated, and the pump can be realized by a well-known structure, and thus a detailed description thereof will be omitted.

The valve body in the water pump 270 can be driven by the pump motor 280. Therefore, according to the present embodiment, water in the water tank 200 can be continuously and stably supplied to the rotation cleaning units 40 and 41 while the pump motor 280 is operating.

The operation of the pump motor 280 can be adjusted by operating the above-described adjusting unit 180. For example, the adjusting unit 180 may select the on/off state of the pump motor 280.

Alternatively, the output (or rotation speed) of the pump motor 280 may be adjusted by the adjusting unit 180.

The nozzle cover 130 is provided with a supporting unit 290 for supporting the adjusting unit 180 so as to be movable, and a variable resistor 292 or one or more switches may be connected to the adjusting unit 180. A signal for controlling the pump motor 280 may be changed based on a change in resistance according to the movement of the variable resistor 292, or a signal for controlling the pump motor 280 may be changed by switching signals of one or more switches.

The nozzle cover 130 may further include at least one fastening boss 148 to be coupled with the nozzle base 110.

In addition, the nozzle cover 130 may be provided with a spray nozzle 149 for spraying water to the rotation cleaning units 40 and 41 to be described later. For example, a pair of spray nozzles 149 may be installed on the nozzle cover 130 in a state where the spray nozzles 149 are spaced apart from each other in the lateral direction.

The nozzle cover 130 may be provided with a nozzle installation boss 149*c* for mounting the spray nozzle 149. For example, the spray nozzle 149 may be fastened to the nozzle installation boss 149*c* by a screw.

The spray nozzle 149 may include a connection unit 149*a* for connecting a branch tube to be described later.

<Nozzle Base>

Figure 12:
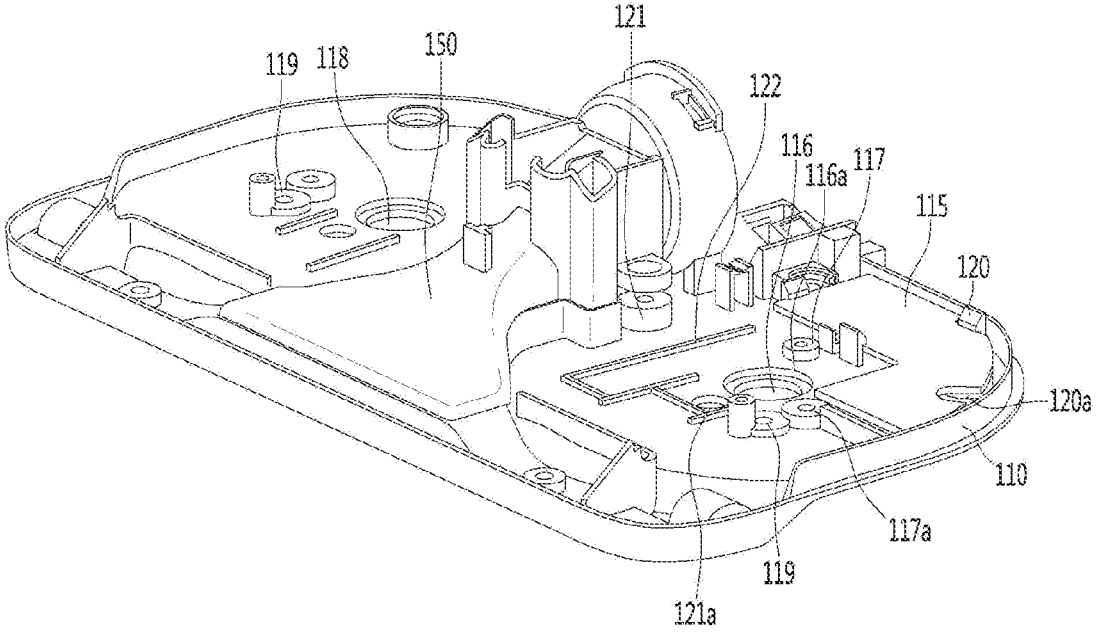
FIG. 12 is a view illustrating a state where a flow path forming portion is coupled to a nozzle base according to an embodiment of the present disclosure.
Figure 13:
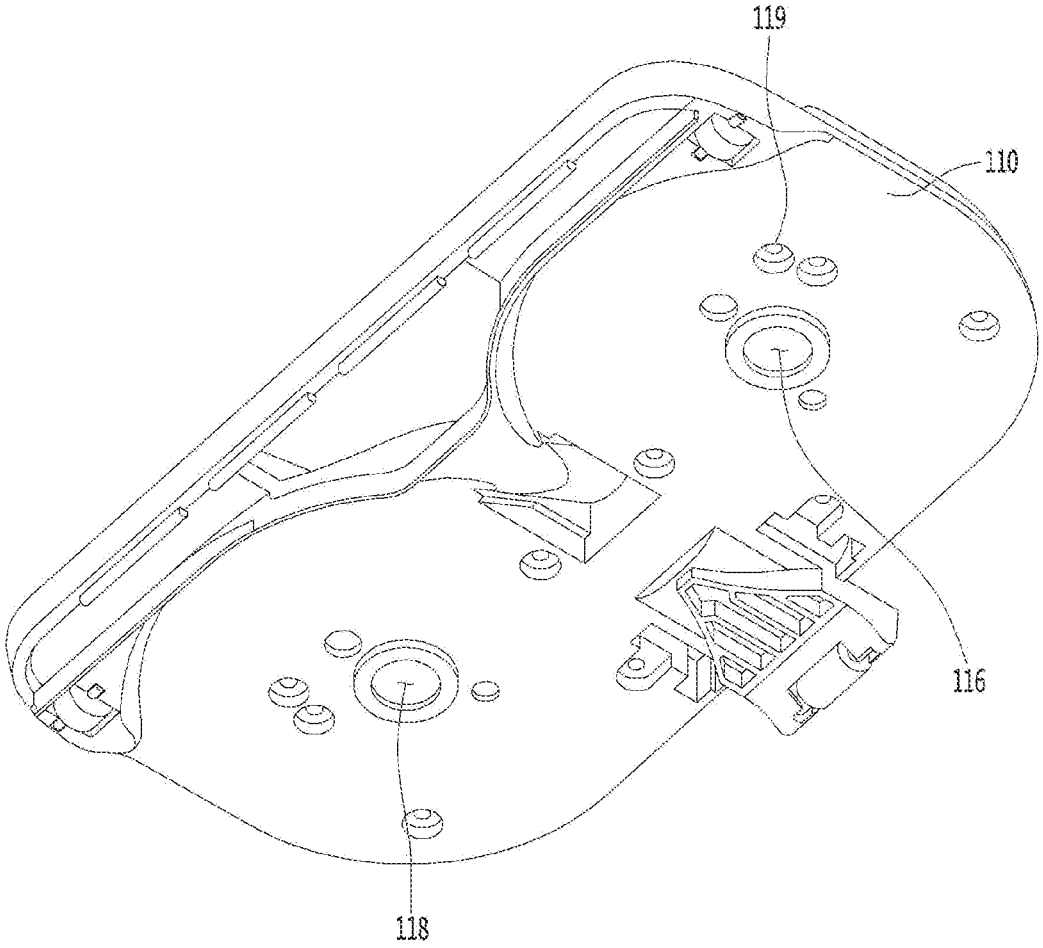
FIG. 13 is a view illustrating a nozzle base according to an embodiment of the present disclosure as viewed from below.

FIG. 12 is a view illustrating a state where a flow path forming portion is coupled to a nozzle base according to an embodiment of the present disclosure, and FIG. 13 is a view illustrating a nozzle base according to an embodiment of the present disclosure as viewed from below.

Referring to FIG. 6, FIG. 12, and FIG. 13, the nozzle base 110 may include a pair of shaft through-holes 116 and 118 through which a transmission shaft (to be described later) that is connected to each of the rotation plates 420 and 440 in each of the driving devices 170 and 171 passes.

The nozzle base 110 is provided with a seating groove 116*a* for seating a sleeve (to be described later) provided in each of the driving devices 170 and 171, and the shaft through-holes 116 and 118 may be formed in the seating groove 116*a*.

The seating groove 116*a* may be formed in, for example, a circular shape, and may be formed by being recessed downward from the nozzle base 110. In addition, the shaft through-holes 116 and 118 may be formed in the bottom of the seating groove 116*a*.

As the sleeve (to be described later) provided in the driving devices 170 and 171 is seated in the seating groove 116*a*, the horizontal movement of the driving devices 170 and 171 may be restricted during the movement of the nozzle 1 or the operation of the driving devices 170 and 171.

Each of the shaft through-holes 116 and 118 may be disposed on both sides of the flow path forming portion 150 in a state where the flow path forming portion 150 is coupled to the nozzle base 110.

The nozzle base 110 may be provided with a board installation portion 120 for installing a control board 115 for controlling each of the driving devices 170 and 171.

The control board 115 may be installed in a horizontal state in a state where the control board 117 is installed in the board installation portion 120. The control board 115 may be installed so as to be spaced apart from the bottom of the nozzle base 110.

This is for preventing water from contacting the control board 116 even when water leaks to the bottom of the nozzle base 110. To this end, the nozzle base 110 may be provided with a support protrusion 120*a* for supporting the control board 116 so as to be spaced apart from the floor.

The board installation portion 120 may be positioned at one side of the flow path forming portion 150 in the nozzle base 110, although not limited thereto. For example, the control board 115 may be disposed at a position adjacent to the adjusting unit 180.

Therefore, the structure for connecting the control board 115 and the variable resistor 292 or switch can be simplified.

In the present embodiment, the control board 115 may be positioned on the opposite side of the valve operating unit 144 with respect to the second flow path 114. This is for preventing water from flowing toward the control board 115 even when water leaks from the valve operating unit 144.

The nozzle base 110 may further include supporting ribs 122 for supporting the lower sides of each of the driving devices 170 and 171 and fastening bosses 117 and 117*a* for fastening each of the driving devices 170 and 171.

The supporting rib 122 protrudes from the nozzle base 110 and is bent one or more times, so that each of the driving devices 170 and 171 is separated from the bottom of the nozzle base 110. Alternatively, a plurality of supporting ribs 122 spaced apart from each other may protrude from the nozzle base 110 to separate the driving devices 170 and 171 from the bottom of the nozzle base 110.

Even when water falls to the bottom of the nozzle base 110, the driving devices 170 and 171 are separated from the bottom of the nozzle base 110 by the supporting ribs 122. Therefore, the flow of water toward the driving devices 170 and 171 can be minimized.

The nozzle base 110 may further include a nozzle hole 119 through which each of the spray nozzles 149 passes.

A portion of the spray nozzle 149 coupled to the nozzle cover 130 may pass through the nozzle hole 119 when the nozzle cover 130 is coupled to the nozzle base 110.

In addition, the nozzle base 110 may further include an avoidance hole 121*a* for preventing interference with the structure of each of the driving devices 170 and 171, and a fastening boss 121 for fastening with the flow path forming portion 150.

Since a part of each of the driving devices 170 and 171 can be positioned in the avoidance hole 121*a*, the supporting rib 122 may be positioned around the avoidance hole 121*a* so that the flow of water into the avoidance hole 121*a* is minimized. For example, the avoidance hole 121*a* may be positioned in the region formed by the supporting rib 122.

Figure 14:
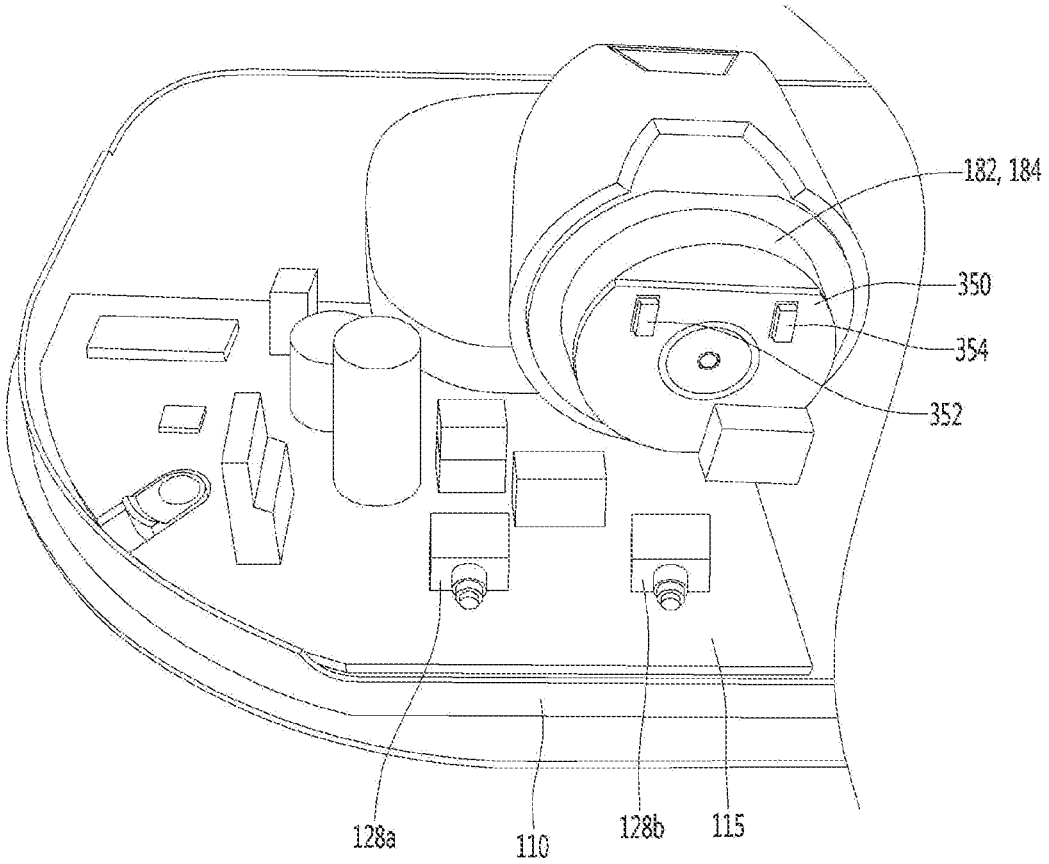
FIG. 14 is a view illustrating a plurality of switches installed in a control board according to an embodiment of the present disclosure.

FIG. 14 is a view illustrating the plurality of switches installed in the control board according to an embodiment of the present disclosure.

Referring to FIGS. 4 and 14, the control board 115 is installed in the nozzle base 110. The plurality of switches 128*a* and 128*b* for detecting the operation of the adjusting unit 180 may be installed on the upper surface of the control board 115.

The plurality of switches 128*a* and 128*b* may be installed in a state of being spaced apart from each other in the left and right direction.

The plurality of switches 128*a* and 128*b* may include a first switch 128*a* for detecting a first position of the adjusting unit 180 and a second switch 128*b* for detecting a second position of the adjusting unit 180.

For example, when the adjusting unit 180 pivots to the left and moves to the first position, the adjusting unit 180 presses the contact point of the first switch 128*a* and the first switch 128*a* is turned on. In this case, the pump motor 280 operates with a first output so that water may be discharged from the water tank 200 by a first amount per unit time.

When the adjusting unit 180 pivots to the right and moves to the second position, the adjusting unit 180 presses the contact point of the second switch 128*b* and the second switch 128*b* is turned on.

In this case, the pump motor 280 operates with a second output greater than the first output, so that water may be discharged from the water tank 200 by a second amount per unit time.

When the adjusting unit 180 is positioned at the neutral position between the first position and the second position, the adjusting unit 180 does not press the contact points of the first switch 128*a* and the second switch 128*b*, and thus the pump motor 280 is stopped.

<Driving Device>

Figure 16:
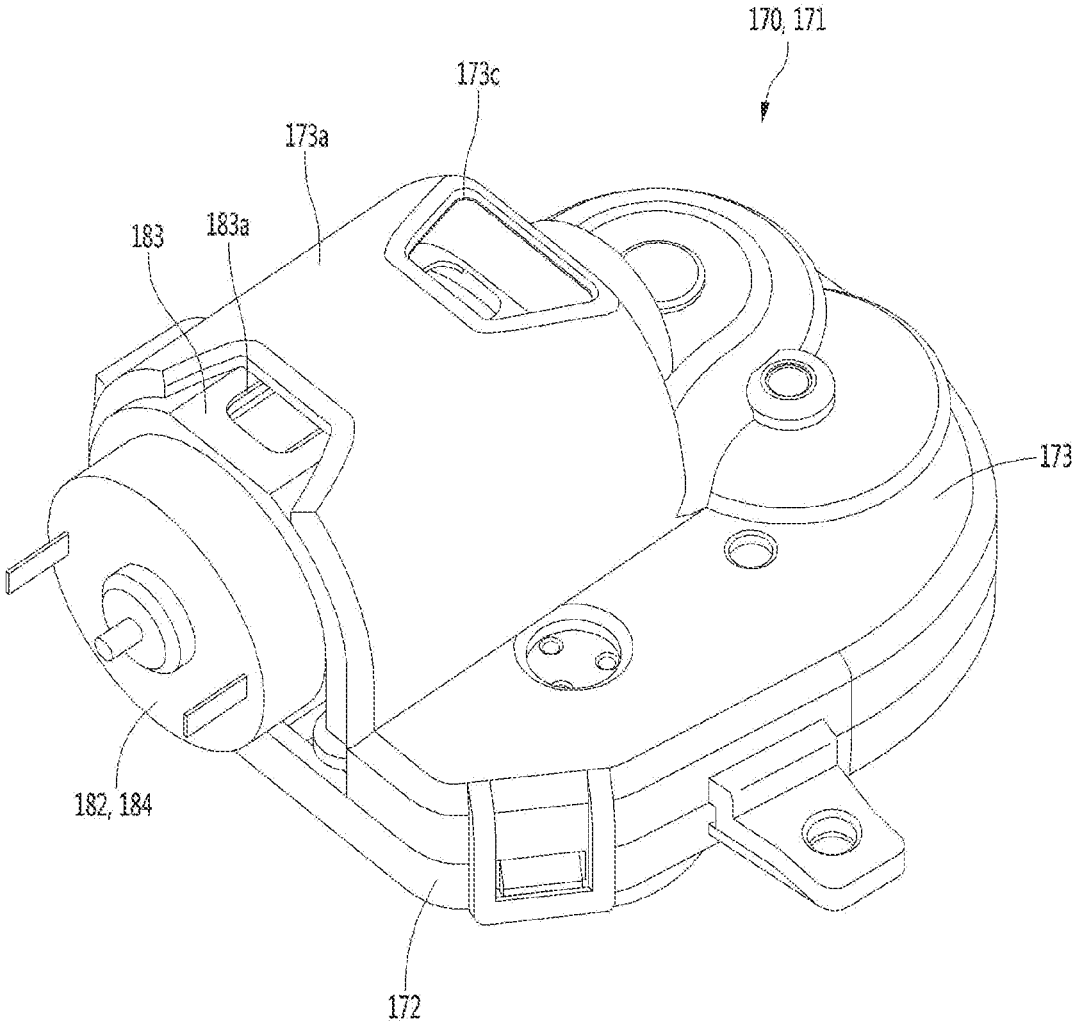
FIG. 16 is a view illustrating first and second driving devices according to an embodiment of the present disclosure as viewed from above.
Figure 17:
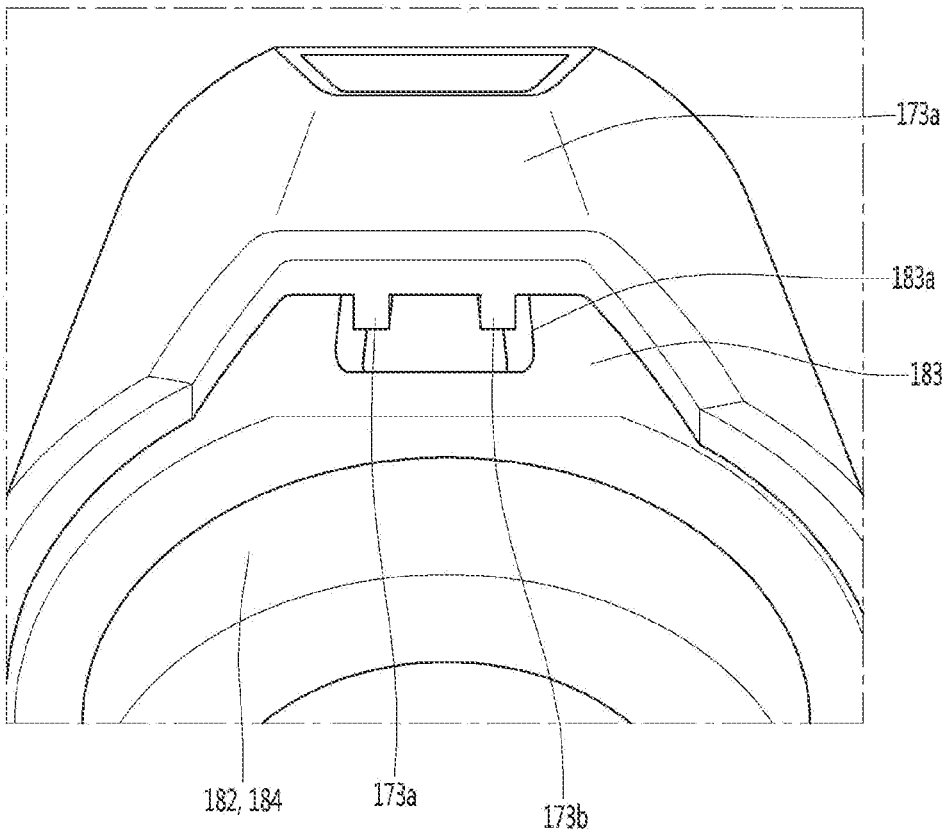
FIG. 17 is a view illustrating a structure for preventing rotation of a motor housing and a driving motor.
Figure 18:
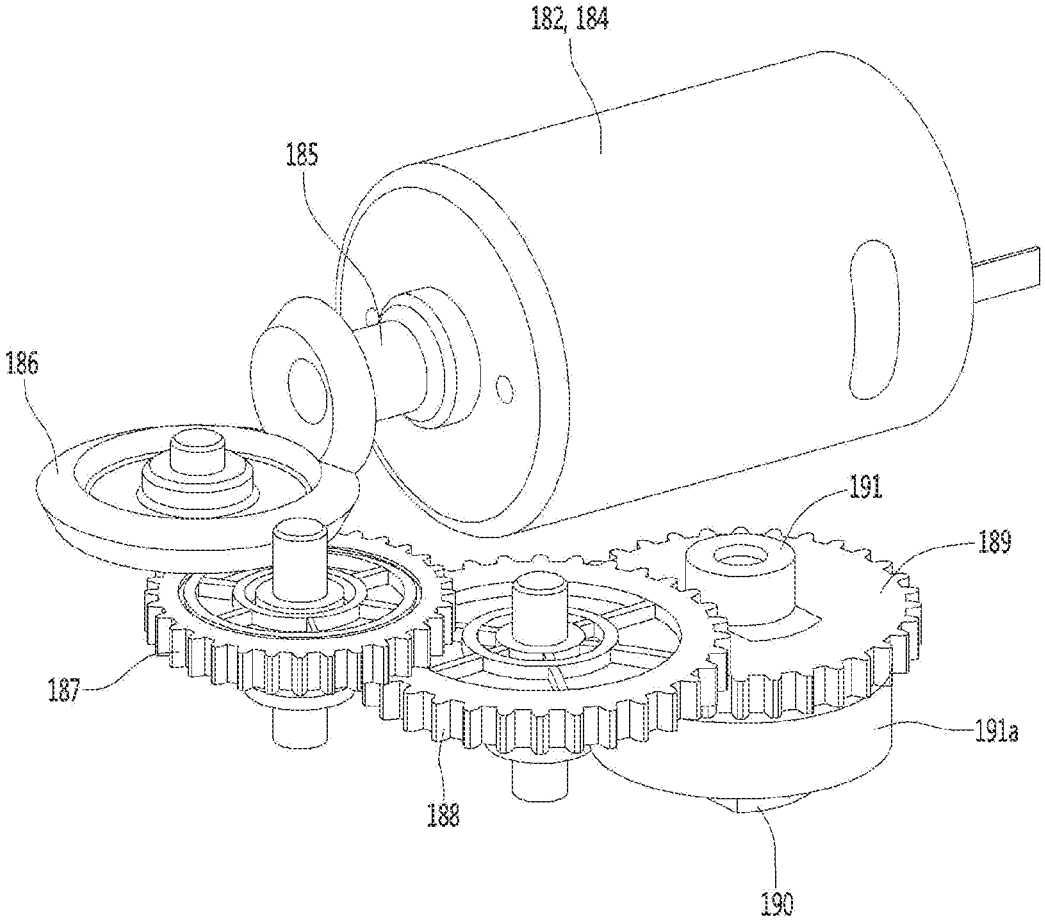
FIG. 18 is a view illustrating a state where a power transmission unit is coupled to a driving motor according to an embodiment of the present disclosure.

FIG. 15 is a view illustrating first and second driving devices according to an embodiment of the present disclosure as viewed from below, FIG. 16 is a view illustrating first and second driving devices according to an embodiment of the present disclosure as viewed from above, FIG. 17 is a view illustrating a structure for preventing rotation of a motor housing and a driving motor, and FIG. 18 is a view illustrating a state where a power transmission unit is coupled to a driving motor according to an embodiment of the present disclosure.

Referring to FIG. 14 to FIG. 18, the first driving device 170 and the second driving device 171 may be formed and disposed symmetrically in the lateral direction.

The first driving device 170 may include a first driving motor 182 and the second driving device 171 may include a second driving motor 184.

A motor PCB 350 for driving the motor may be connected to each of the driving motors 182 and 184. The motor PCB 350 may be connected to the driving motors 182 and 184 in an erected state.

The motor PCB 350 may be provided with a pair of resistors 352 and 354 for improving the electro magnetic interference (EMI) performance of the driving motor. One of the pair of resistors 352 and 354 is connected to the (+) terminal of the driving motor, and the other resistor is connected to the (−) terminal of the drive motor. Thus, the fluctuation of the output of the driving motor is reduced. For example, the pair of resistors 352 and 354 may be spaced apart from the motor PCB 350 to the left and right.

Each of the driving devices 170 and 171 may further include a motor housing. The driving motors 182 and 184 and a power transmission unit for transmitting power can be received in the motor housing.

The motor housing may include, for example, a first housing 172, and a second housing 173 coupled to the upper side of the first housing 172.

The axis of each of the driving motors 182 and 184 may substantially extend in the horizontal direction in a state where each of the driving motors 182 and 184 is installed in the motor housing.

The first housing 172 may have a shaft hole 175 through which the transmission shaft 190 for coupling with the rotation plates 420 and 440, among the power transmission unit, passes. For example, a portion of the transmission shaft 190 may protrude downward through the lower side of the motor housing.

The horizontal section of the transmission shaft 190 may be formed in a non-circular shape such that relative rotation of the transmission shaft 190 is prevented in a state where the transmission shaft 190 is coupled with the rotation plates 420 and 440.

A sleeve 174 may be provided around the shaft hole 175 in the first housing 172 and the second housing 173. The sleeve 174 may protrude from the lower surfaces of the first housing 172 and the second housing 173.

The sleeve 174 may be formed in a ring shape, for example. Therefore, the sleeve 174 can be seated in the seating groove 116 which is formed in a circular shape.

The driving motors 182 and 184 may be seated on the first housing 172 and fixed to the first housing 172 by the motor fixing unit 183 in this state.

The driving motors 182 and 184 may be formed in a cylindrical shape and the driving motors 182 and 184 may be seated in the first housing 172 in a state where the axes of the driving motors 182 and 184 are substantially horizontal (in a state where driving motors 182 and 184 are lying down).

The motor fixing unit 183 may be formed in an approximately semicircular shape in cross section and may surround a portion of the driving motors 182 and 184 seated on the first housing 172. The motor fixing unit 183 may be fixed to the first housing 172 by a fastening member such as a screw, as an example.

The second housing 173 may include a motor cover 173*a* covering a portion of the driving motors 182 and 184.

The motor cover 173*a* may be rounded so as to surround the motor fixing unit 183 from the outside of the motor fixing unit 183, for example.

For example, the motor cover 173*a* may be formed in a round shape such that a portion of the second housing 173 protrudes upward.

Rotation preventing ribs 173*a* and 173*b* are formed on the surface of the motor cover 173*a* facing the motor fixing unit 183 so as to prevent relative rotation between the motor cover 173*a* and the motor fixing unit 183 during the operation of the driving motors 182 and 184, and a rib receiving slot 183*a* in which the rotation preventing ribs 173*a* and 173*b* are received can be formed in the motor fixing unit 183.

Though not limited, the width of the rotation preventing ribs 173*a* and 173*b* and the width of the rib receiving slot 183*a* may be the same.

Alternatively, a plurality of rotation preventing ribs 173*a* and 173*b* may be spaced apart in the motor cover 173*a* in the circumferential direction of the driving motors 182 and 184, and the plurality of rotation preventing ribs 173*a* and 173*b* can be received in the rib receiving slot 183*a*.

At this time, the maximum width of the plurality of rotation preventing ribs 173*a* and 173*b* in the circumferential direction of the driving motors 182 and 184 may be equal to or slightly smaller than the width of the rib receiving slot 183*a*.

The power transmission unit may include a driving gear 185 connected to the shaft of each of the driving motors 182 and 184 and a plurality of transmission gears 186, 187, 188, and 189 for transmitting the rotational force of the driving gear 185.

The axis of the driving motors 182 and 184 (A3 and A4) extends in the horizontal direction while the rotation centerline of the rotation plates 420 and 440 extends in the vertical direction. Therefore, the driving gear 185 may be a spiral bevel gear, for example.

The plurality of transmission gears 186, 187, 188, and 189 may include a first transmission gear 186 that engages with the driving gear 185. The first transmission gear 186 may have a rotation center extending in a vertical direction. The first transmission gear 186 may include a spiral bevel gear so that the first transmission gear 186 can engage with the driving gear 185.

The first transmission gear 186 may further include a helical gear disposed at a lower side of the spiral bevel gear as a two-stage gear.

The plurality of transmission gears 186, 187, 188 and 189 may further include a second transmission gear 187 engaged with the first transmission gear 186.

The second transmission gear 187 may be a two-stage helical gear. In other words, the second transmission gear 187 includes two helical gears arranged vertically, and the upper helical gear can be connected to the helical gear of the second transmission gear 187.

The plurality of transmission gears 186, 187, 188 and 189 may further include a third transmission gear 188 engaged with the second transmission gear 187.

The third transmission gear 188 may also be a two-stage helical gear. In other words, the third transmission gear 188 includes two helical gears arranged vertically, and the upper helical gear of the third transmission gear 188 may be connected to the lower helical gear of the second transmission gear 187.

The plurality of transmission gears 186, 187, 188 and 189 may further include a fourth transmission gear 189 engaged with the lower helical gear of the third transmission gear 188. The fourth transmission gear 189 may be a helical gear.

A transmission shaft 190 may be coupled to the fourth transmission gear 189. The transmission shaft 190 may be coupled to penetrate the fourth transmission gear 189. An upper bearing 191 is coupled to the upper end of the transmission shaft 190 passing through the fourth transmission gear 189 and a lower bearing 191*a* is coupled to the transmission shaft 190 at the lower side of the fourth transmission gear 189. The transmission shaft 190 may be rotated together with the fourth transmission gear 189.

Figure 19:
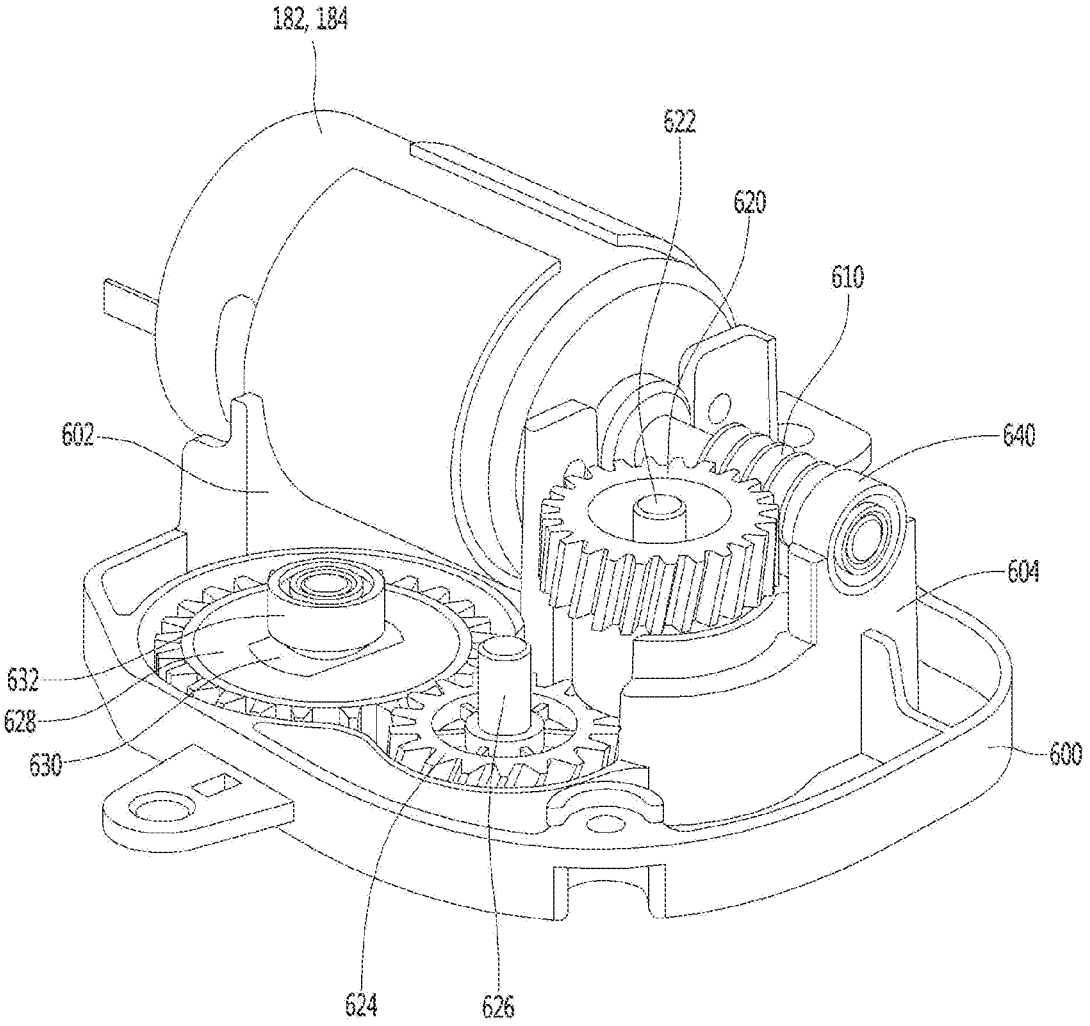
FIG. 19 is a view illustrating a state where a power transmission unit is coupled to a driving motor according to another embodiment of the present disclosure.

FIG. 19 is a view illustrating a state where a power transmission unit is coupled to a driving motor according to another embodiment of the present disclosure.

The present embodiment is the same as the previous embodiment in other portions but differs in the power transmission unit.

Referring to FIG. 19, the power transmission unit of the present embodiment may include a driving gear 610 connected to the shafts of the driving motors 182 and 184.

The driving gear 610 may be a worm gear. The rotational shaft of the driving gear 610 may extend in the horizontal direction. A bearing 640 may be connected to the driving gear 610. The first housing 600 for supporting the driving motors 182 and 184 may include a motor support portion 602 for supporting the driving motors 182 and 184 and a bearing support portion 604 for supporting the bearings 640.

The power transmission unit may further include a plurality of transmission gears 620, 624 and 628 for transmitting the rotational force of the driving gear 610 to the rotation plates 420 and 440.

The plurality of transmission gears 620, 624 and 628 may include a first transmission gear 620 engaged with the driving gear 610. The first transmission gear 620 may include an upper worm gear to engage with the driving gear 610.

Since the driving gear 610 and the second transmission gear 620 mesh with each other in the form of a worm gear, there is an advantage that noise is reduced by friction in a process in which the rotational force of the driving gear 610 is transmitted to the second transmission gear 620.

The first transmission gear 620 may include a helical gear disposed at the lower side of the upper worm gear as a two-stage gear.

The first transmission gear 620 may be rotatably connected to a first shaft 622 extending in the vertical direction. The first shaft 622 may be fixed to the first housing 600.

Accordingly, the first transmission gear 620 can be rotated with respect to the fixed first shaft 622. According to the present embodiment, since the first transmission gear 620 is configured to rotate with respect to the first shaft 622, there is an advantage that a bearing is unnecessary.

The plurality of transmission gears 620, 624, and 628 may further include a second transmission gear 624 engaged with the first transmission gear 620. The second transmission gear 624 is, for example, a helical gear.

The second transmission gear 624 may be rotatably connected to a second shaft 626 extending in the vertical direction. The second shaft 626 may be fixed to the first housing 600.

Accordingly, the second transmission gear 624 can be rotated with respect to the fixed second shaft 626. According to the present embodiment, since the second transmission gear 624 is configured to rotate with respect to the second shaft 626, there is an advantage that no bearing is required.

The plurality of transmission gears 620, 624, and 628 may further include a third transmission gear 628 engaged with the second transmission gear 624. The third transmission gear 628 is, for example, a helical gear.

The third transmission gear 628 may be connected to a transmission shaft 630 connected to the rotation plates 420 and 440. The transmission shaft 630 may be connected to the third transmission gear 628 and rotated together with the third transmission gear 628.

A bearing 632 may be coupled to the transmission shaft 630 for smooth rotation of the transmission shaft 630.

<Disposition of Driving Device in Nozzle Base>

Figure 20:
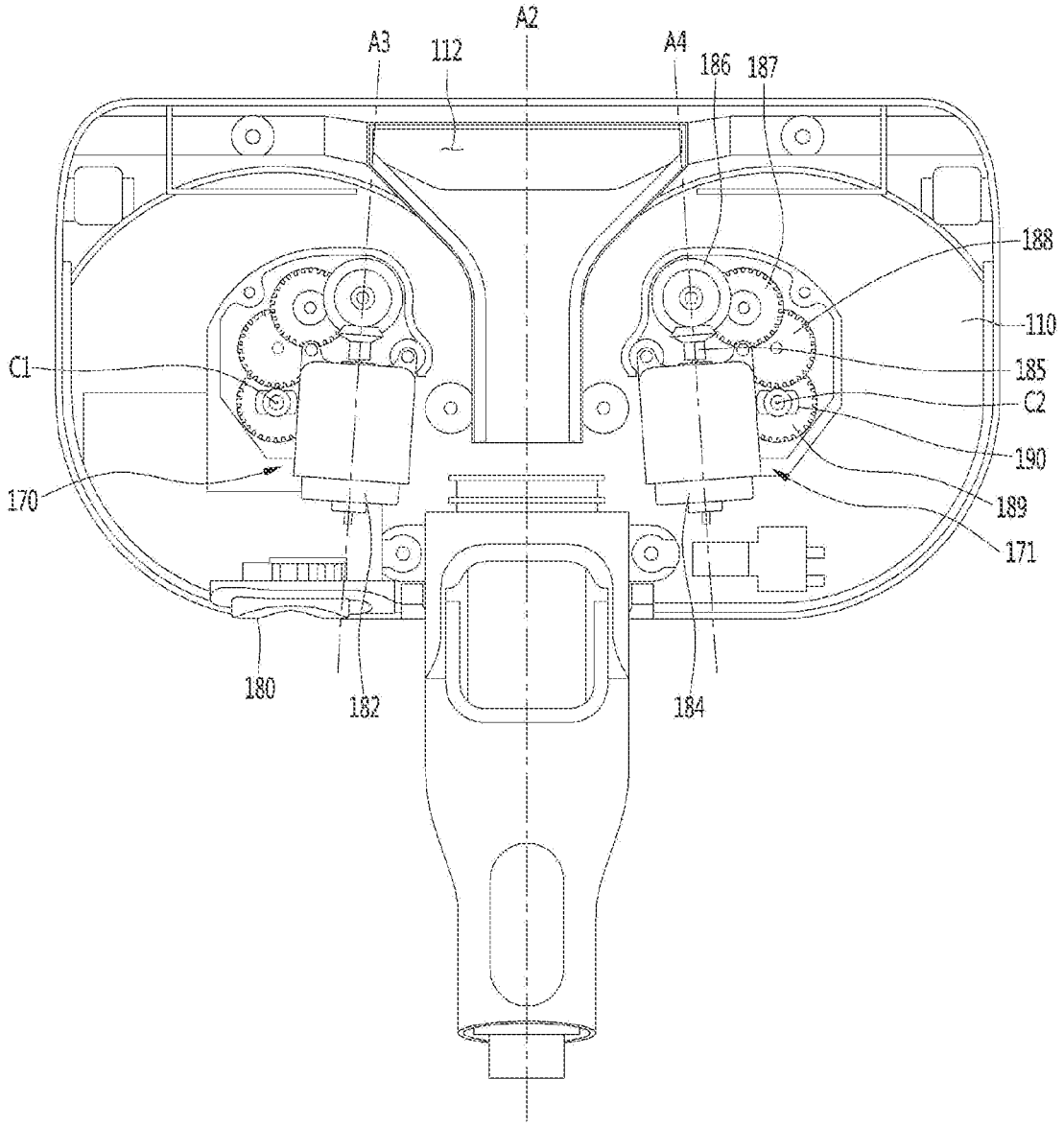
FIG. 20 is a view illustrating a state where a driving device is installed in a nozzle base according to an embodiment of the present disclosure.
Figure 21:
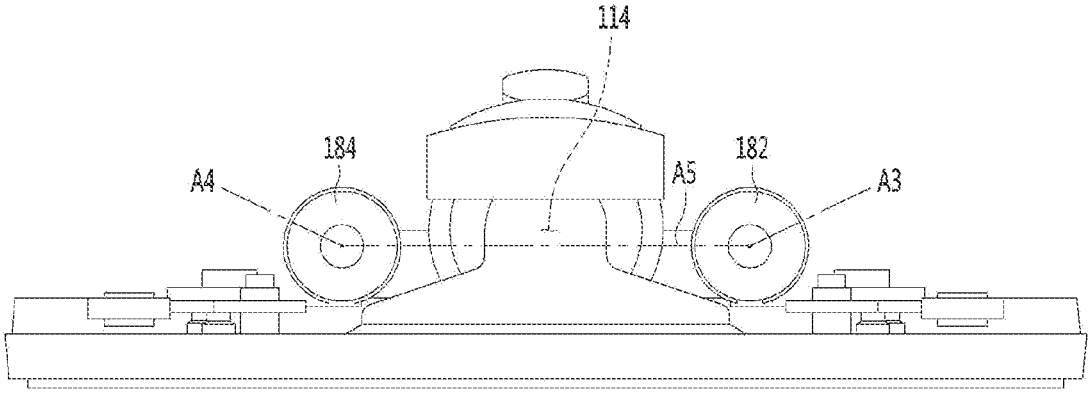
FIG. 21 is a front view illustrating a state where a driving device is installed in a nozzle base according to an embodiment of the present disclosure.

FIG. 20 is a view illustrating a state where the driving device is installed in the nozzle base according to an embodiment of the present disclosure, and FIG. 21 is a front view illustrating a state where the driving device is installed in the nozzle base according to an embodiment of the present disclosure.

However, FIG. 20 illustrates a state in which the second housing of the motor housing is removed.

Referring to FIGS. 20 and 21, as described above, each of the driving devices 170 and 171 may be spaced apart from the nozzle base 110 to the left and right.

In this case, the centerline A2 of the second flow path 114 may be positioned between the first driving device 170 and the second driving device 171.

Although not limited, the axis line A3 of the first driving motor 182 and the axis line A4 of the second driving motor 184 may extend in the front and rear direction.

The axis line A3 of the first driving motor 182 and the axis line A4 of the second driving motor 184 may be parallel or arranged to form a predetermined angle.

In the present embodiment, an imaginary line A5 connecting the axis A3 of the first driving motor 182 and the axis A4 of the second driving motor 184 passes through the second flow path 114. This is because each of the driving motors 182 and 184 is positioned close to the rear side of the nozzle 1 so that the increase in the height of the nozzle 1 by the driving motors 182 and 184 can be prevented.

In a state where the driving gears 185 and 185 are connected to the shaft of each of the driving motors 182 and 184, so that the increase in the height of the nozzle 1 is minimized by each of the driving devices 170 and 171, the driving gear 185 may be positioned between the driving motors 182 and 184 and the first flow path 112.

In this case, since the driving motors 182 and 184 having the longest vertical length, among the driving devices 170 and 171, are positioned as close as possible to the rear side in the nozzle main body 10, the increase in height of a side of the front end portion of the nozzle 1 can be minimized.

Since the driving devices 170 and 171 are positioned close to the rear side of the nozzle 1 and the water tank 200 is positioned above the driving devices 170 and 171, the center of gravity of the nozzle 1 may be pulled toward the rear side of the nozzle 1 due to the weight of the water in the water tank 200 and the driving devices 170 and 171.

Accordingly, in the present embodiment, the connection chamber (see 226 of FIG. 6) of the water tank 200 is positioned between the first flow path 112 and the driving devices 170 and 170 with respect to the front and rear directions of the nozzle 1.

Meanwhile, in the present embodiment, the rotation centers C1 and C2 of the rotation plates 420 and 440 coincide with the rotation center of the transmission shaft 190.

The axes A3 and A4 of the driving motors 182 and 184 can be positioned in the region between the rotation centers C1 and C2 of the rotation plates 420 and 440.

In addition, the driving motors 182 and 184 may be positioned in a region between the rotation centers C1 and C2 of the rotation plates 420 and 440.

In addition, each of the driving motors 182 and 184 may be disposed so as to overlap with the imaginary line connecting the first rotation center C1 and the second rotation center C2 in the vertical direction.

<Rotation Plate>

Figure 22:
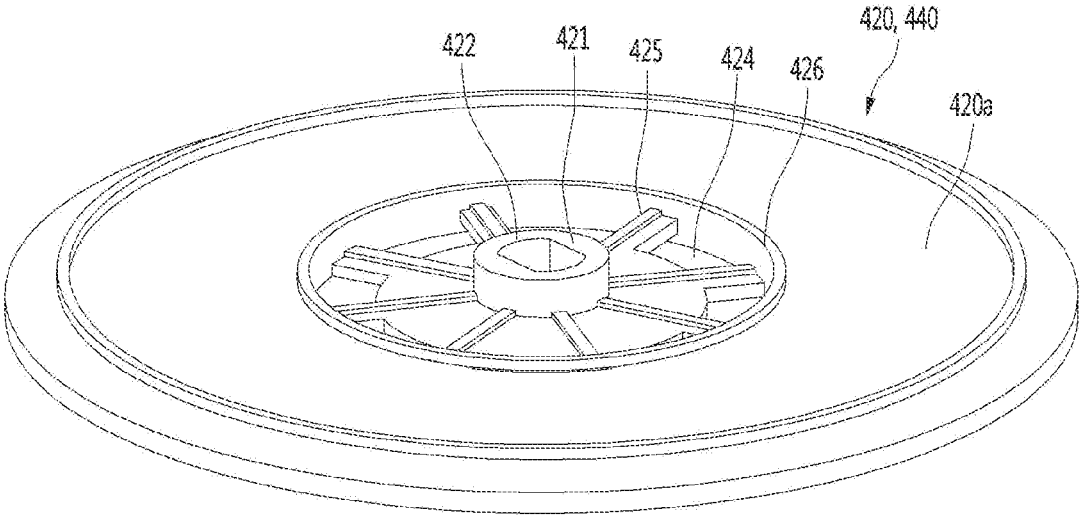
FIG. 22 is a view illustrating a rotation plate according to an embodiment of the present disclosure as viewed from above.
Figure 23:
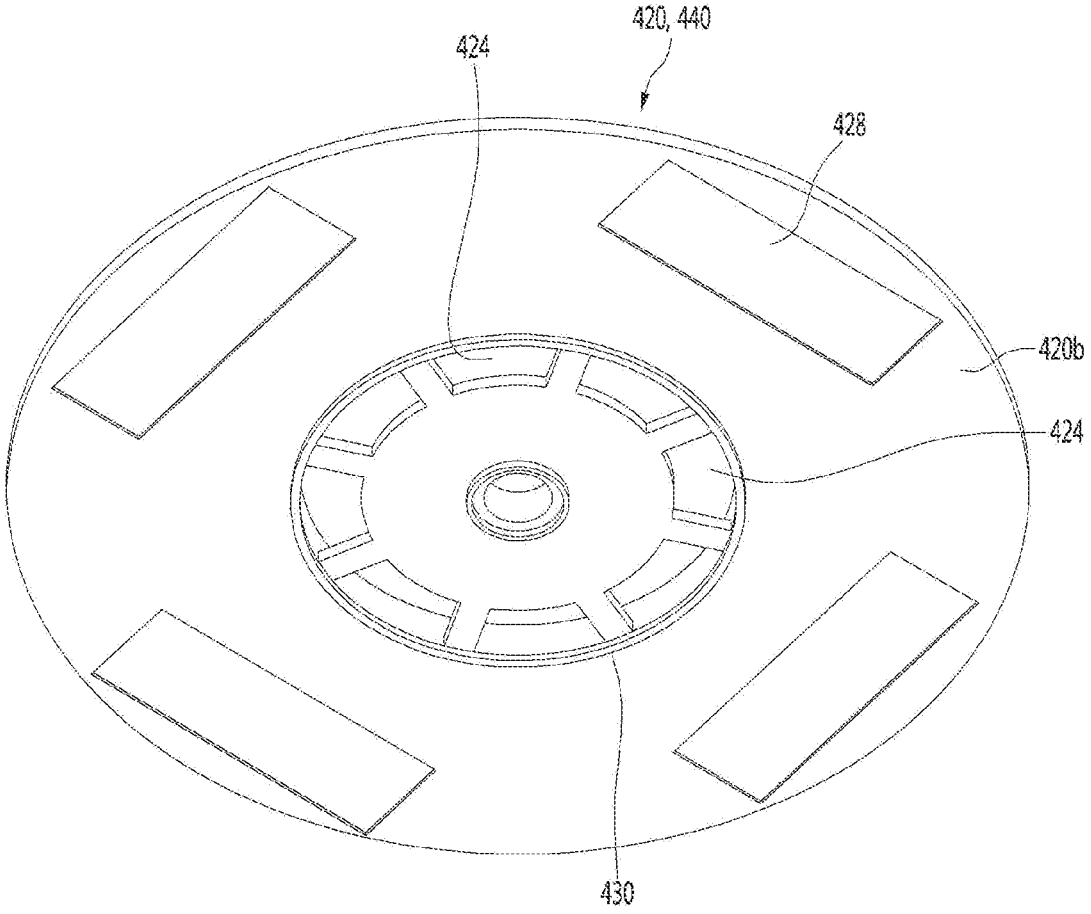
FIG. 23 is a view illustrating a rotation plate according to an embodiment of the present disclosure as viewed from below.

FIG. 22 is a view illustrating a rotation plate according to an embodiment of the present disclosure as viewed from above, and FIG. 23 is a view illustrating a rotation plate according to an embodiment of the present disclosure as viewed from below.

Referring to FIG. 22 and FIG. 23, a shaft coupling unit 421 for coupling the transmission shaft 190 may be provided at a central portion of each of the rotation plates 420 and 440.

For example, the transmission shaft 190 may be inserted into the shaft coupling unit 421. For this purpose, a shaft receiving groove 422 for inserting the transmission shaft 190 may be formed in the shaft coupling unit 421.

A fastening member may be drawn into the shaft coupling unit 421 from below the rotation plates 420 and 440 and be fastened to the transmission shaft 190 in a state where the transmission shaft 190 is coupled to the shaft coupling unit 421.

The rotation plates 420 and 440 may include a plurality of water passage holes 424 disposed outwardly of the shaft coupling unit 421 in the radial direction.

In the present embodiment, since the rotation plates 420 and 440 are rotated in a state where the mops 402 and 404 are attached to the lower sides of the rotation plates 420 and 440, the plurality of water passage holes 424 may be spaced apart in a circumferential direction around the shaft coupling unit 421 so as to smoothly supply water to the mops 402 and 404 through the rotation plates 420 and 440.

The plurality of water passage holes 424 may be defined by a plurality of ribs 425. At this time, each of the ribs 425 may be positioned lower than the upper surface 420*a* of the rotation plates 420 and 440.

Since the rotation plates 420 and 440 rotate, centrifugal force acts on the rotation plates 420 and 440. It is necessary to prevent the water sprayed to the rotation plates 420 and 440 from flowing radially outward in a state where the water cannot pass through the water passage holes 424 in the rotation plates 420 and 440 due to the centrifugal force.

Therefore, a water blocking rib 426 may be formed on the upper surface 420*a* of the rotation plates 420 and 440 at a radially outside of the water passage hole 424. The water blocking ribs 426 may be formed continuously in the circumferential direction. In other words, the plurality of water passage holes 424 may be positioned in the inner region of the water blocking ribs 426. The water blocking ribs 426 may be formed in, for example, a circular ring shape.

An installation groove 428 may be formed on the lower surface 420*b* of the rotation plates 420 and 440 to provide attachment means for attaching the mops 402 and 404. The attachment means can be, for example, a velcro.

A plurality of installation grooves 428 may be spaced apart in the circumferential direction with respect to the rotation centers C1 and C2 of the rotation plates 420 and 440. Therefore, a plurality of attachment means may be provided on the lower surface 420*b* of the rotation plates 420 and 440.

In the present embodiment, the installation groove 428 may be disposed radially outward of the water passage hole 424 with respect to the rotation centers C1 and C2 of the rotation plates 420 and 440.

For example, the water passage hole 424 and the installation groove 428 may be sequentially arranged radially outward from the rotation centers C1 and C2 of the rotation plates 420 and 440.

Contact ribs 430 in contact with the mops 402 and 404 may be provided on a lower surface 420*b* of the rotation plates 420 and 440 in a state where the mops 402 and 404 are attached to the attachment means.

The contact ribs 430 may protrude downward from the lower surface 420*b* of the rotation plates 420 and 440.

The contact ribs 430 are disposed radially outward of the water passage holes 424 and may be formed continuously in the circumferential direction. For example, the contact ribs 430 may be formed in a circular ring shape.

Since the mops 402 and 404 can be deformed by itself, for example, as a fiber material, gaps can exist between the mops 402 and 404 and the lower surfaces 420*b* of the rotation plates 420 and 440 in a state where the mops 402 and 404 are attached to the rotation plates 420 and 440 by the attaching means.

When the gap existing between the mops 402 and 404 and the lower surfaces 420*b* of the rotation plates 420 and 440 is large, there is a fear that water is not absorbed to the mops 402 and 404 in a state of passing through the water passage hole 424 and flows to the outside through the gap between the lower surfaces 420*b* of the rotation plates 420 and 440 and the upper surface of the mops 402 and 404.

However, according to the present embodiment, when the mops 402 and 404 are coupled to the rotation plates 420 and 440, the contact ribs 430 can be brought into contact with the mops 402 and 404, and when the nozzle 1 is placed on the floor, the contact ribs 430 press the mops 402 and 404 by the load of the nozzle 1.

Accordingly, the contact ribs 430 prevent the formation of the gap between the lower surfaces 420*d* of the rotation plates 420 and 440 and the upper surfaces of the mops 402 and 404 and thus water to pass through the water passage holes 424 can be smoothly supplied to the mops 402 and 404.

<Water Supply Flow Path>

Figure 24:
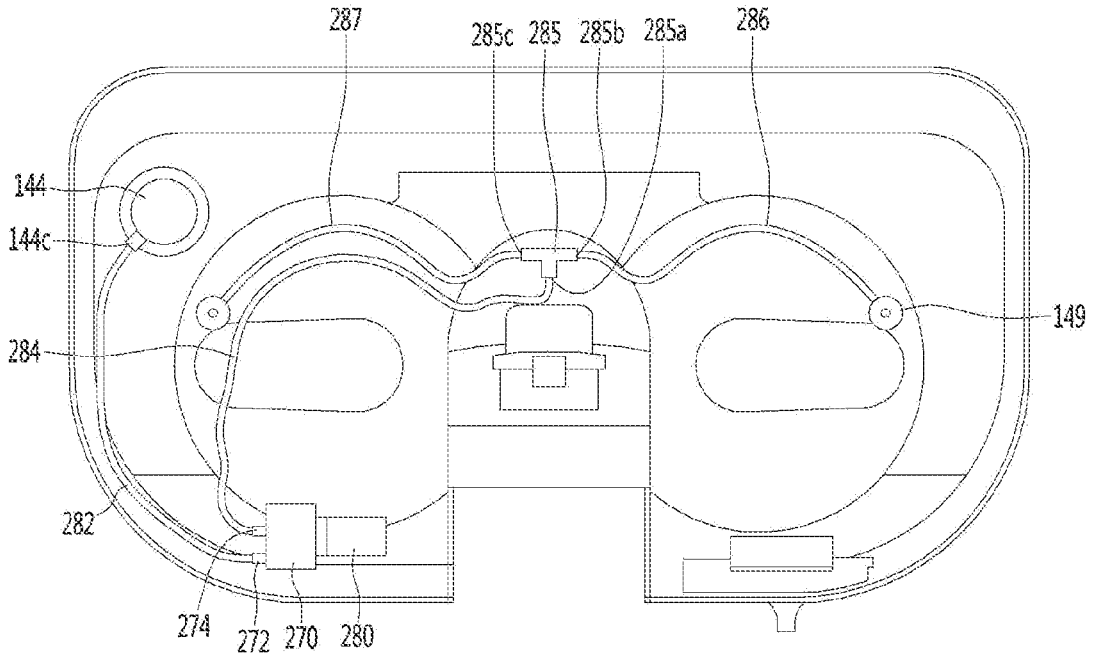
FIG. 24 is a view illustrating a water supply flow path for supplying water in a water tank to a rotation cleaning unit according to an embodiment of the present disclosure.
Figure 25:
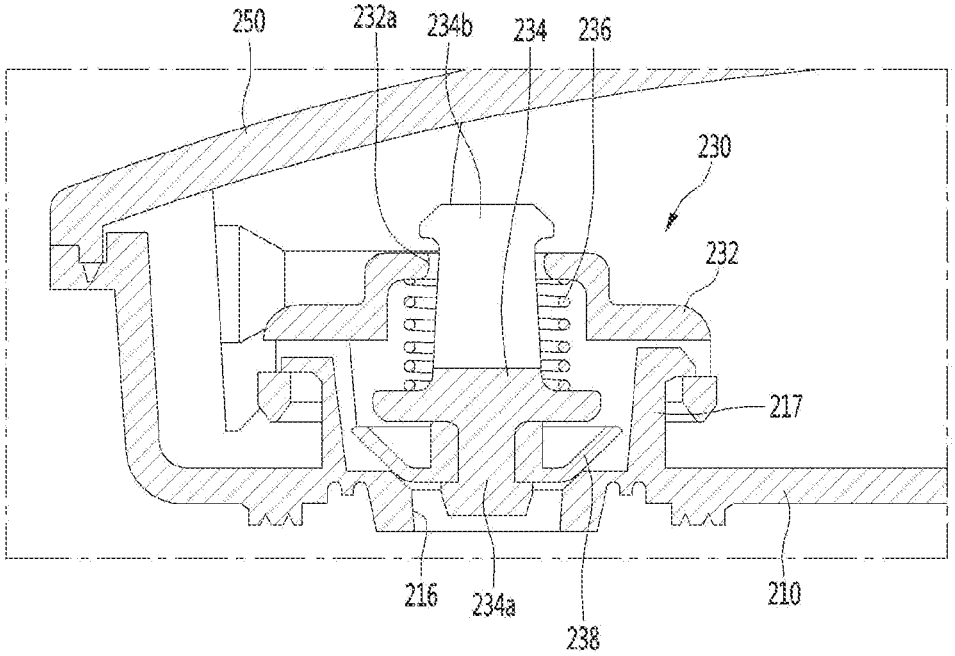
FIG. 25 is a view illustrating a valve in a water tank according to an embodiment of the present disclosure.
Figure 26:
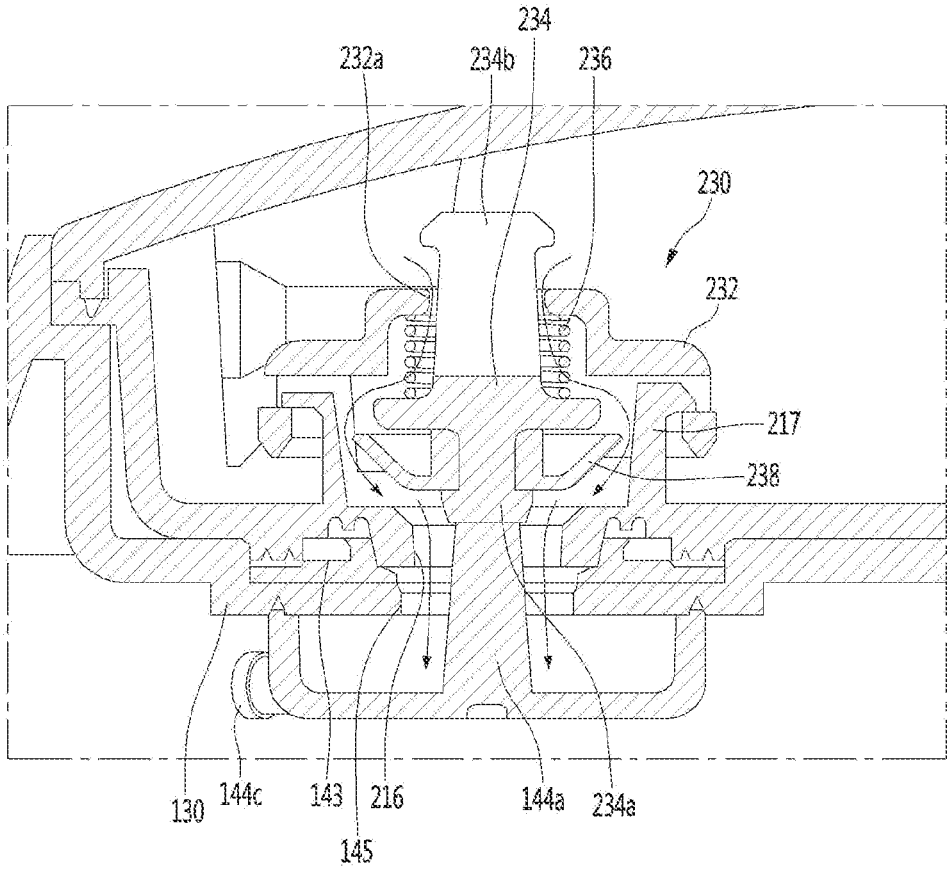
FIG. 26 is a view illustrating a state where a valve opens a discharge port while a water tank is mounted on a nozzle housing.

FIG. 24 is a view illustrating a water supply flow path for supplying water of a water tank to the rotation cleaning unit according to an embodiment of the present disclosure, FIG. 25 is a view illustrating a valve in a water tank according to an embodiment of the present disclosure, and FIG. 26 is a view illustrating a state where the valve opens the discharge port in a state where the water tank is mounted on the nozzle housing.

Figure 27:
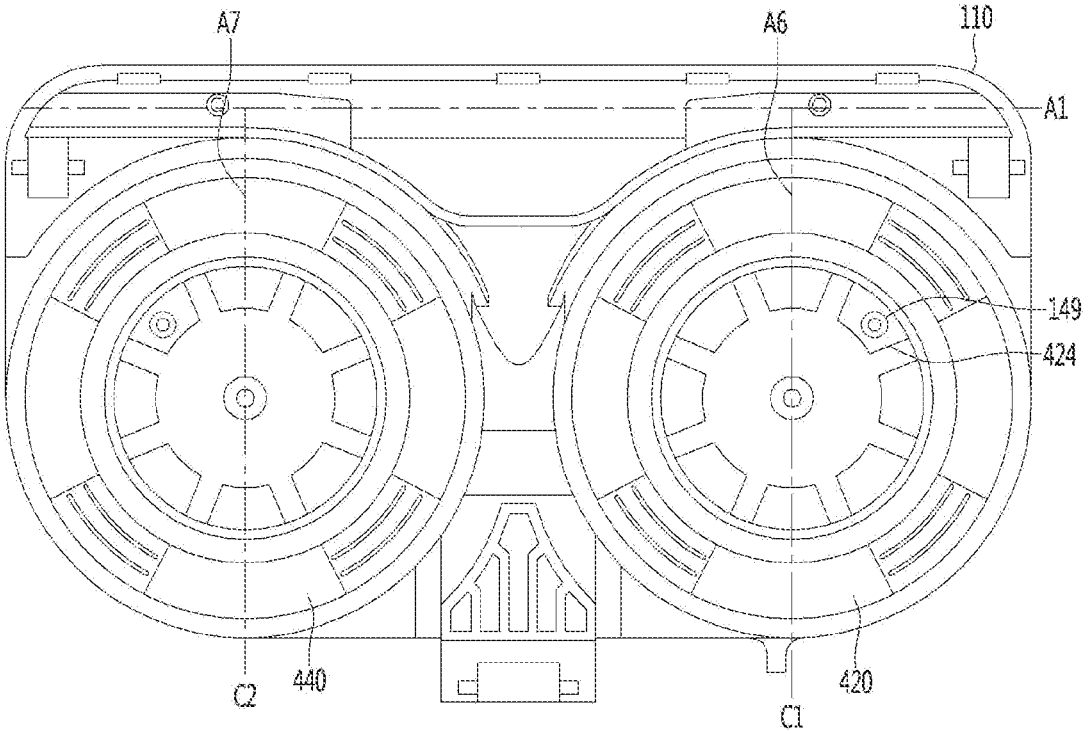
FIG. 27 is a view illustrating a state where a rotation plate is coupled to a nozzle main body according to an embodiment of the present disclosure.
Figure 28:
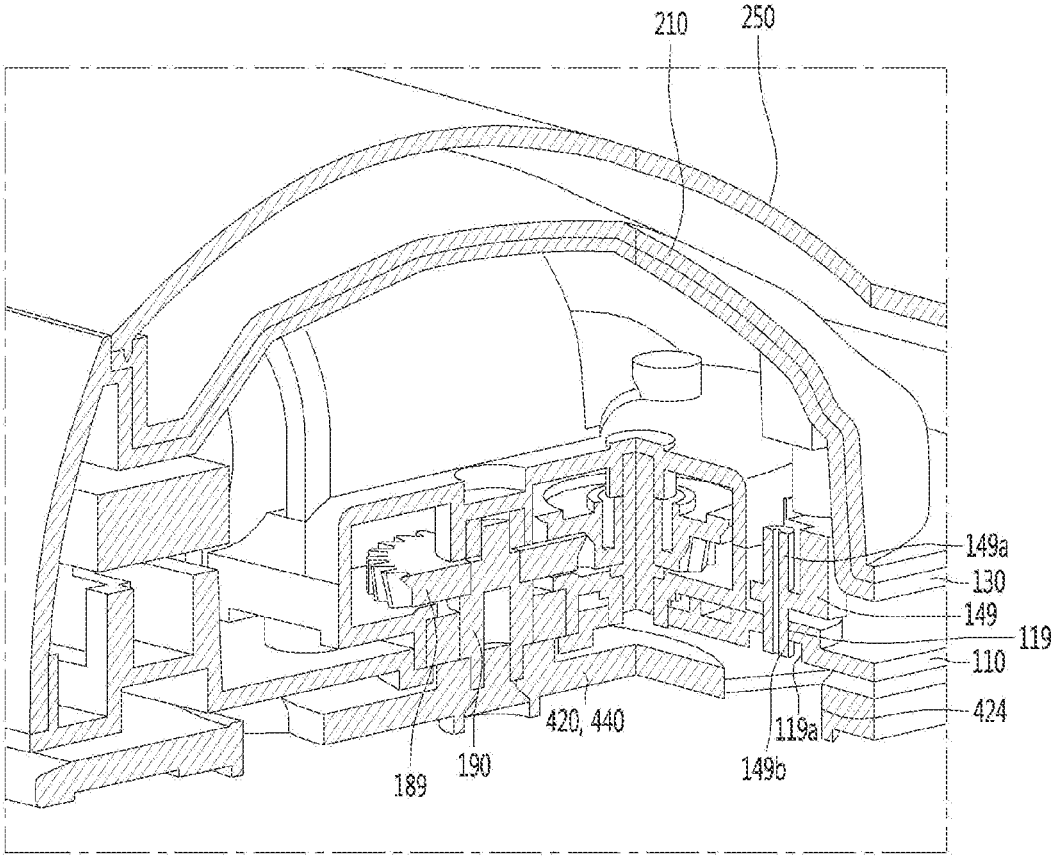
FIG. 28 is a view illustrating an arrangement of a spray nozzle in a nozzle main body according to an embodiment of the present disclosure.

FIG. 27 is a view illustrating a rotation plate connected to a nozzle main body according to an embodiment of the present disclosure and FIG. 28 is a view illustrating a disposition of a spray nozzle in a nozzle main body according to an embodiment of the present disclosure.

Figure 29:
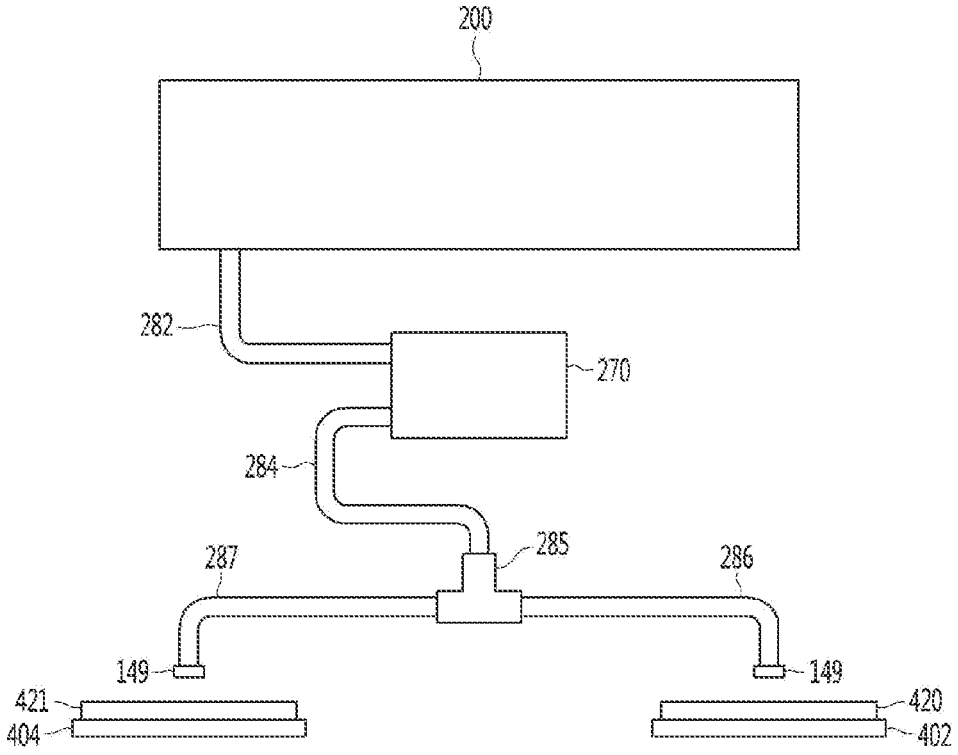
FIG. 29 is a conceptual diagram illustrating a process of supplying water from a water tank to a rotation cleaning unit according to an embodiment of the present disclosure.

FIG. 29 is a conceptual diagram illustrating a process of supplying water from a water tank to a rotation cleaning unit according to an embodiment of the present disclosure.

Referring to FIG. 24 to FIG. 29, the water supply flow path of the present embodiment includes a first supply tube 282 connected to the valve operating unit 144, a water pump 270 connected to the first supply tube 282, and a second supply tube 284 connected to the water pump 270.

The water pump 270 may include a first connection port 272 to which the first supply tube 282 is connected and a second connection port 274 to which the second supply tube 284 is connected. On the basis of the water pump 270, the first connection port 272 is an inlet, and the second connection port 274 is a discharge port.

The water supply flow path may further include a connector 285 to which the second supply tube 284 is connected.

The connector 285 may be formed such that the first connection unit 285*a*, the second connection unit 285*b*, and the third connection unit 285*c* are arranged in a T-shape. The second connection tube 284 may be connected to the first connection unit 285*a*.

The water supply flow path may further include a first branch tube 286 connected to the second connection unit 285*b* and a second branch tube 287 connected to the third connection unit 285*b*.

Accordingly, the water flowing through the first branch tube 286 may be supplied to the first rotation cleaning unit 40 and the water flowing through the second branch tube 287 may be supplied to the second rotation cleaning unit 41.

The connector 285 may be positioned at the central portion of the nozzle main body 10 such that each of the branch tubes 286 and 287 has the same length.

For example, the connector 285 may be positioned below the flow path cover 136 and above the flow path forming portion 150. That is, the connector 285 may be positioned directly above the second flow path 114. Thus, substantially the same amount of water can be dispensed from the connector 285 to each of the branch tubes 286 and 287.

In the present embodiment, the water pump 270 may be positioned at one point on the water supply flow path.

At this time, the water pump 270 may be positioned between the valve operating unit 144 and the first connection unit 285*a* of the connector 285 so that water can be discharged from the water tank 200 using a minimum number of the water pumps 270.

In the present embodiment, the water pump 270 may be installed in the nozzle cover 130 in a state where the water pump 270 is positioned close to the portion where the valve operating unit 144 is installed. As an example, the valve operating unit 144 and the water pump 270 may be provided on one side of both sides of the centerline A2 of the second flow path 114 with respect to the centerline A2 of the second flow path 114 in the nozzle main body 10.

Therefore, the length of the first supply tube 282 can be reduced, and accordingly, the length of the water supply flow path can be reduced.

Each of the branch tubes 286 and 287 may be connected to the spray nozzle 149. The spray nozzle 149 can also form the water supply flow path of the present disclosure.

The spray nozzle 149 may include a connection unit 149*a* to be connected to each of the branch tubes 286 and 287 as described above.

The spray nozzle 149 may further include a water discharge port 149*b*. The water discharge port 149*b* extends downward through the nozzle hole 119. In other words, the water discharge port 149*b* may be disposed on the outside of the nozzle housing 100.

When the water discharge port 149*b* is positioned outside the nozzle housing 100, water sprayed through the water discharge port 149*b* can be prevented from being drawn into the nozzle housing 100.

At this time, so as to prevent the water discharge port 149*b* exposed to the outside of the nozzle housing 100 from being damaged, grooves 119*a* recessed upward are formed in the bottom of the nozzle base 110 and the water discharge port 149*b* may be positioned in the groove 119*a* in a state of passing through the nozzle hole 119. In other words, the nozzle hole 119 may be formed in the groove 119*a*.

The water discharge port 149*b* may be disposed to face the rotation plates 420 and 440 in the groove 119*a*.

Thus, the water sprayed from the water discharge port 149*b* can pass through the water passage hole 424 of the rotation plates 420 and 440.

A line perpendicularly connecting the first rotation center C1 and the centerline A1 of the first flow path 112 may be referred to as a first connection line A6, and a line perpendicularly connecting the second rotation center C2 and an axis A1 of the first flow path 112 may be referred to as a second connecting line A7.

At this time, the first connection line A6 and the second connection line A7 may be positioned in a region between a pair of the spray nozzle 149 for supplying water to each of the rotation cleaning units 40 and 41.

This is because components constituting the driving devices 170 and 171 exist in the area between the first connection line A6 and the second connection line A7, so the spray nozzle 419 was disposed such that interference with the components is prevented.

In addition, the horizontal distance between water discharge port 149*b* and the centerline A1 of the first flow path 112 is shorter than the horizontal distance between each of the rotation centers C1 and C2 and the centerline A1 of the first flow path 112.

Meanwhile, the valve 230 may include a movable unit 234, an opening/closing unit 238, and a fixing unit 232.

The fixing unit 232 may be fixed to a fixing rib 217 protruding upward from the first body 210 of the water tank 200.

The fixing unit 232 may have an opening 232*a* through which the movable unit 234 passes.

The fixing unit 232 restricts the movable unit 234 from moving upward at a predetermined height from the fixing unit 232 in a state where the fixing unit 232 is coupled with the fixing rib 217.

The movable unit 234 can be moved in the vertical direction in a state where a portion of the movable unit 234 passes through the opening 232*a*. In a state where the movable unit 234 is moved upward, water can pass through the opening 232*a*.

The movable unit 234 may include a first extension portion 234*a* extending downward and coupled with the opening/closing unit 238 and a second extension portion 234*b* extending upwardly and passing through the opening 232*a*.

The movable unit 234 may be elastically supported by an elastic member 236. One end of the elastic member 263, as a coil spring, for example, may be supported by the fixed portion 232 and the other end may be supported by the movable unit 234.

The elastic member 236 provides a force to the movable unit 234 to move the movable unit 234 downward.

The opening/closing unit 238 can selectively open the discharge port 216 by moving the movable unit 234 up and down.

At least a portion of the opening/closing unit 238 may have a diameter larger than the diameter of the discharge port 216 so that the opening/closing unit 238 may block the discharge port 216.

The opening/closing unit 238 may be formed of, for example, a rubber material so that the leakage of water is prevented in a state where the opening/closing unit 238 blocks the discharge port 216.

The elastic force of the elastic member 236 is applied to the movable unit 234 so that a state where the opening/closing unit 238 blocks the discharge port 216 can be maintained unless an external force is applied to the movable unit 234.

The movable unit 234 can be moved by the valve operating unit 144 in the process of mounting the water tank 200 to the nozzle main body 10.

The valve operating unit 144 is coupled to the nozzle cover 130 from below the nozzle cover 130 as described above. A water passage hole 145 through which the water discharged from the water tank 200 may be formed at the nozzle cover 130.

The valve operating unit 144 may include a pressing portion 144*a* passing through the water passage hole 145. The pressing portion 144*a* may protrude upward from the bottom of the nozzle cover 130 through the water passage hole 145 of the nozzle cover 130.

The valve operating unit 144 may form a water supply flow path together with the bottom of the nozzle cover 130. A connection tube 144*c* for connecting the first supply tube 282 may be provided at one side of the valve operating unit 144.

The diameter of the water passage hole 145 may be larger than the outer diameter of the pressing portion 144*a* so that water flows smoothly in a state where the pressing portion 144*a* passes through the water passage hole 145.

When the water tank 200 is mounted on the nozzle main body 10, the pressing portion 144*a* is drawn into the discharge port 216 of the water tank 200. The pressing portion 144*a* presses the movable unit 234 in a process in which the pressing portion 144*a* is being drawn into the discharge port 216 of the water tank 200.

Then, the movable unit 234 is lifted and the opening/closing unit 238 coupled to the movable unit 234 moves upward together with the movable unit 234 to be separated from the discharge port 216 to open the discharge port 216.

The water in the water tank 200 is discharged through the discharge port 216 and then flows through the valve operating unit 144 by the water passage hole 145. The water is supplied to the first supply tube 282 connected to the connection tube 144*c*.

The water supplied to the first supply tube 282 flows into the second supply tube 284 after being drawn into the water pump 270. The water flowing into the second supply tube 284 flows to the first branch tube 286 and the second branch tube 287 by the connector 285. The water flowing into each of the branch tubes 286 and 287 is sprayed from the spray nozzle 149 toward the rotation cleaning units 40 and 41.

The water sprayed from the spray nozzle 149 is supplied to the mops 402 and 404 after passing through the water passage holes 424 of the rotation plates 420 and 440. The mops 402 and 404 rotates and wipes the floor in a state where the water supplied to the mops 402 and 404 is absorbed.

According to the proposed disclosure, not only there is provided an inlet that can suctions foreign substances on a floor, but the mops can wipe the floor by rotating the rotation plates to which the mops are attached, so the floor cleaning performance can be improved.

Further, since the water tank can be attached to the nozzle and supply water to the mops, there is an advantage that convenience for a user is increased.

Further, according to the present embodiment, since a flow path extends forward and rearward at the center portion of the nozzle and the driving devices for rotating rotation cleaning portions are disposed at both sides of the flow path, an increase in length of an air flow path for air to flow is prevented, so an increase in loss of flow path can be prevented.

Further, according to the present embodiment, since a plurality of rotation members to which mops are attached are independently driven by a plurality of motors, there is an advantage in that even if some of the plurality of motors are broken, cleaning can be performed by the others.

Further, since the water tank is disposed to surround the driving unit cover that covers the driving devices, the amount of water that can be stored in the water tank can be increased and an increase in height of the entire nozzle can be prevented.

<Motor Speed Control>

Figure 30:
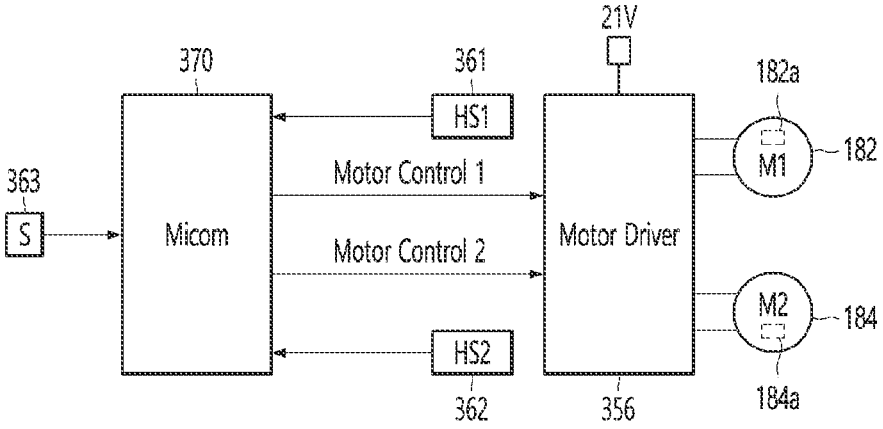
FIG. 30 is a block diagram schematically illustrating some components of the present disclosure.
Figure 31:
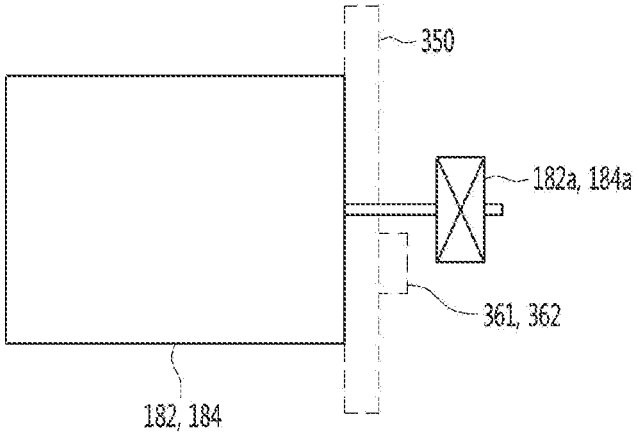
FIG. 31 is a conceptual diagram schematically illustrating a configuration of a motor and a sensing unit.

FIG. 30 is a block diagram schematically illustrating some components of the present disclosure. FIG. 31 is a conceptual diagram schematically illustrating a configuration of a motor and a sensing unit.

Referring to FIGS. 30 to 31, the nozzle of the cleaner according to the present disclosure may include a first sensing unit 361 for sensing a rotation speed of a first driving motor 182, a second sensing unit 362 for sensing a rotation speed of a second driving motor 184, and a control unit 370 for receiving the rotation speeds of the first and second driving motors 182 and 184 sensed by the first and second sensing units 361 and 362 and controlling the rotation speeds of the first and second driving motors 182 and 184.

In addition, the first and second sensing units 361 and 362 may detect the number of rotations of the first and second driving motors 182 and 184.

The control unit 370 may be integrally formed with a motor PCB 350 connected to each of the driving motors 182 and 184 in order to drive the driving motors 182 and 184.

In contrast, the control unit 370 may be formed separately from the motor PCB 350.

The control unit 370 may be provided as a micom.

The control unit 370 may be connected to a motor driver 356 provided in the motor PCB 350 and may control the number of rotations per unit time (rotation speed) of the driving motors 182 and 184. The motor driver 356 independently controls the rotation speeds of the driving motors 182 and 184.

Various embodiments may occur in a range in which the first and second sensing units 361 and 362 can sense the rotation speeds of the driving motors 182 and 184, respectively.

For example, the first and second sensing units 361 and 362 may be provided as rotary type encoders.

As another example, the first and second sensing units 361 and 362 may be provided as hall sensors.

At this time, first and second magnets 182*a* and 184*a* detectable by the hall sensor may be coupled to the rotation shafts of the first and second driving motors 182 and 184.

The first and second magnets 182*a* and 184*a* rotate together with the rotational shafts of the first and second driving motors 182 and 184.

In addition, the first and second sensing units 361 and 362 provided as the hall sensors are mounted at positions facing the first and second magnets 182*a* and 184*a*.

Therefore, when the rotational shafts of the first and second driving motors 182 and 184 rotate once, the first and second magnets 182*a* and 184*a* also rotate once, and the hall sensors may sense the first and second magnets 182*a* and 184*a* once. The rotations of the first and second driving motors 182 and 184 are counted.

In this manner, the first and second sensing units 361 and 362 may count the number of rotations of the first and second drive motors 182 and 184. Using this, it is possible to measure the rotation speeds of the first and second driving motors 182 and 184.

The control unit 370 may compare the rotation speeds of the first and second driving motors 182 and 184 sensed by the first sensing unit 361 and the second sensing unit 362, and may selectively adjust the rotation speeds of the first and second driving motors 182 and 184 according to the comparison result.

When the first and second driving motors 182 and 184 are operated, the first rotation plate 420 and the second rotation plate 440 rotate, and the first mop 402 and the second mop 404 attached to the first rotation plate 420 and the second rotation plate 440 rotate.

In this case, when the rotation speeds of the first and second driving motors 182 and 184 are different from each other, it may be difficult to move the nozzle main body 10 straight. In detail, when the rotation speeds of the first and second driving motors 182 and 184 are different from each other, the nozzle main body 10 generates a force to move sideways rather than forward. In particular, a force to move in a direction in which the rotation speed is relatively slow is generated.

When the first driving motor 182 rotates faster than the second driving motor 184, the first mop 402 rotates faster than the second mop 404, and the driving force of the first mop 402 becomes greater than the driving force of the second mop 404. Due to this imbalance, the nozzle main body 10 moves in a direction toward the second mop 404 as a center, and as viewed from above, the nozzle main body 10 inclines downward in a direction of the second mop 404.

In order to move the nozzle main body 10 forward, the user has to hold the handle (not illustrated) connected to the upper side of the nozzle main body 10 with more force, and push the handle (not illustrated) forward with more force.

When the user does not exert a force on the handle (not illustrated), the nozzle main body 10 will randomly move toward one side or the other side of the nozzle main body 10 rather than the front side.

As described above, when the rotation speeds of the first and second driving motors 182 and 184 are different from each other, the straightness of the nozzle main body 10 is deteriorated, and the user has to operate the handle while applying a greater force so as to move the nozzle main body 10 forward. Therefore, the user's operating convenience is degraded and the user's fatigue is inevitably increased.

<Rotation Speed Synchronization>

In the case of the present disclosure, the rotation speeds of the first and second driving motors 182 and 184 connected to the first mop 402 and the second mop 404 are sensed in real time and compared with each other. Then, the rotation speeds of the first and second driving motors 182 and 184 are controlled so that the first and second driving motors 182 and 184 rotate at the same or similar speed.

Therefore, the first mop 402 and the second mop 404 disposed on both sides of the nozzle main body 10 rotate at the same or similar speed. As a result, while the nozzle main body 10 does not change its direction at random, the straight traveling performance of the nozzle main body 10 can be improved. In addition, since the user can operate the handle connected to the nozzle main body without exerting great effort, the user's convenience of operation during the cleaning process can be improved and the user fatigue can be reduced.

In detail, the control unit 370 compares the real-time rotation speeds of the first and second driving motors 182 and 184 sensed by the first sensing unit 361 and the second sensing unit. As a result of the comparison, when the difference between the rotation speeds of the first and second driving motors 182 and 184 is greater than a reference value set by the user, the output of the corresponding motor can be controlled so that the rotation speed of the driving motor with a relatively low rotation speed is increased.

As an example, when the rotation speed of the first driving motor 182 is lower than the rotation speed of the second driving motor 184 and the difference between the rotation speeds of the first and second driving motors 182 and 184 is greater than the reference value, the control unit 370 may increase the rotation speed of the first driving motor 182 by transmitting a motor speed command (PWM DUTY) of the first driving motor 182 to the motor driver 356 connected to the first driving motor 182.

As another example, when the rotation speed of the second driving motor 184 is lower than the rotation speed of the first driving motor 184 and the difference between the rotation speeds of the first and second driving motors 184 and 184 is greater than the reference value, the control unit 370 may increase the rotation speed of the second driving motor 184 by transmitting a motor speed command (PWM DUTY) of the second driving motor 184 to the motor driver 356 connected to the second driving motor 184.

Meanwhile, the control unit 370 compares the real-time rotation speeds of the first and second driving motors 182 and 184 sensed by the first sensing unit 361 and the second sensing unit. As a result of the comparison, when the difference between the rotation speeds of the first and second driving motors 182 and 184 is greater than a reference value set by the user, the output of the corresponding driving motor can be controlled so that the rotation speed of the driving motor having a relatively high rotation speed is reduced.

In addition, the control unit 370 compares the real-time rotation speeds of the first and second driving motors 182 and 184 sensed by the first sensing unit 361 and the second sensing unit. As a result of the comparison, when the difference between the rotation speeds of the first and second driving motors 182 and 184 is less than or equal to the reference value, the rotation speeds of the first and second driving motors 182 and 184 are maintained.

For example, the control unit 370 may maintain the rotation speeds of the first and second driving motors 182 and 184 at the current state only when the rotation speeds of the first and second driving motors are the same.

According to the present disclosure as described above, the rotation speeds of the first and second driving motors disposed on both sides of the nozzle main body 10 are fed back and synchronized. As a result, the straight traveling performance of the nozzle main body 10 can be increased, and the feeling of operation that the user feels can be improved.

<Change in Direction of Nozzle>

Referring to FIG. 30 again, the nozzle of the cleaner according to the present disclosure may further include a direction detection sensor 363 that detects a change in the traveling direction of the nozzle main body 10 or the handle (not illustrated) connected to the nozzle main body 10 and transmits the detected change to the control unit 370.

As an example, the direction detection sensor 363 may be provided as a displacement sensor, an acceleration sensor, a tilt sensor, a gyro sensor, or the like.

As described above, when the first and second driving motors 182 and 184 are operated, the first rotation plate 420 and the second rotation plate 440 rotate, and the first mop 402 and the second mop 404 attached to the first rotation plate 420 and the second rotation plate 440 rotate.

In this case, when the rotational speeds of the first and second driving motors 182 and 184 are different from each other, it may be difficult to move the nozzle main body 10 straight. In detail, when the rotational speeds of the first and second driving motors 182 and 184 are different from each other, the nozzle main body 10 generates a force to move sideways rather than forward. In particular, a force to move in a direction in which the rotational speed is relatively slow is generated.

When the first driving motor 182 rotates faster than the second driving motor 184, the first mop 402 rotates faster than the second mop 404, and the driving force of the first mop 402 becomes greater than the second mop 404. Due to this imbalance, the nozzle main body 10 moves in a direction toward the second mop 404 as a center, and as viewed from above, the nozzle main body 10 inclines downward in a direction of the second mop 404.

In the case of the present disclosure, this phenomenon is used so that the user can more easily change the driving direction of the nozzle main body 10.

In detail, when the user wants to rotate or move the nozzle main body 10 to the left, the user attempts to change the direction of the nozzle main body 10 using the handle (not illustrated). The direction detection sensor 363 detects the direction change of the nozzle main body 10.

As described above, when the direction detection sensor 363 detects the direction change of the nozzle main body 10 to the left, the output of the driving motor is controlled so that the control unit 370 makes the rotation speed of the first driving motor 182 disposed on the left (based on FIG. 20) less than the rotation speed of the second driving motor 184 disposed on the right (based on FIG. 20).

As described above, when the rotation speed of the first driving motor 182 is less than the rotation speed of the second driving motor 184, the second mop 404 rotates faster than the first mop 402, and thus the driving force of the second mop 404 is greater than the first mop 402. Due to such an imbalance in force (driving force), the nozzle main body 10 is inclined toward the first mop 402. The user can more easily change the traveling direction of the nozzle main body 10 to the left without exerting a large amount of force. First of all, in the wet mop cleaning process, the friction between the floor on which the cleaning is performed and the mop is large, and the weight of the nozzle main body 10 provided with the water tank is also heavy, Thus, in order to change the direction of the nozzle main body 10, the user has to exert great effort. However, as described above, when the rotation speed of the first driving motor 182 and the rotation speed of the second driving motor 184 are independently adjusted, it is possible to more easily change the traveling direction of the nozzle main body 10 with less force.

In addition, when the direction detection sensor 363 detects the direction change of the nozzle main body 10 to the right side, the control unit 370 may control the output so that the rotation speed of the second driving motor 184 disposed on the right side is less than the rotation speed of the first driving motor 182 disposed on the left side.

In detail, when the user wants to rotate or move the nozzle main body 10 to the right, the user attempts to change the direction of the nozzle main body 10 using the handle (not illustrated). The direction detection sensor 363 detects the direction change of the nozzle main body 10.

As described above, when the direction detection sensor 363 detects the direction change of the nozzle main body 10 to the right, the output of the driving motor is controlled so that the control unit 370 makes the rotation speed of the second driving motor 184 disposed on the right (based on FIG. 20) less than the rotation speed of the first driving motor 182 disposed on the left (based on FIG. 20).

As described above, when the rotation speed of the second driving motor 184 is less than the rotation speed of the first driving motor 182, the first mop 402 rotates faster than the second mop 404, and thus the driving force of the first mop 402 is greater than the second mop 404. Due to such an imbalance in force (driving force), the nozzle main body 10 is inclined toward the second mop 404. The user can more easily change the traveling direction of the nozzle main body 10 to the right without exerting a large amount of force. First of all, in the wet mop cleaning process, the friction between the floor on which the cleaning is performed and the mop is large, and the weight of the nozzle main body 10 provided with the water tank is also heavy, Thus, in order to change the direction of the nozzle main body 10, the user has to exert great effort. However, as described above, when the rotation speed of the first driving motor 182 and the rotation speed of the second driving motor 184 are independently adjusted, it is possible to more easily change the traveling direction of the nozzle main body 10 with less force.

<Control Method>

Figure 32:
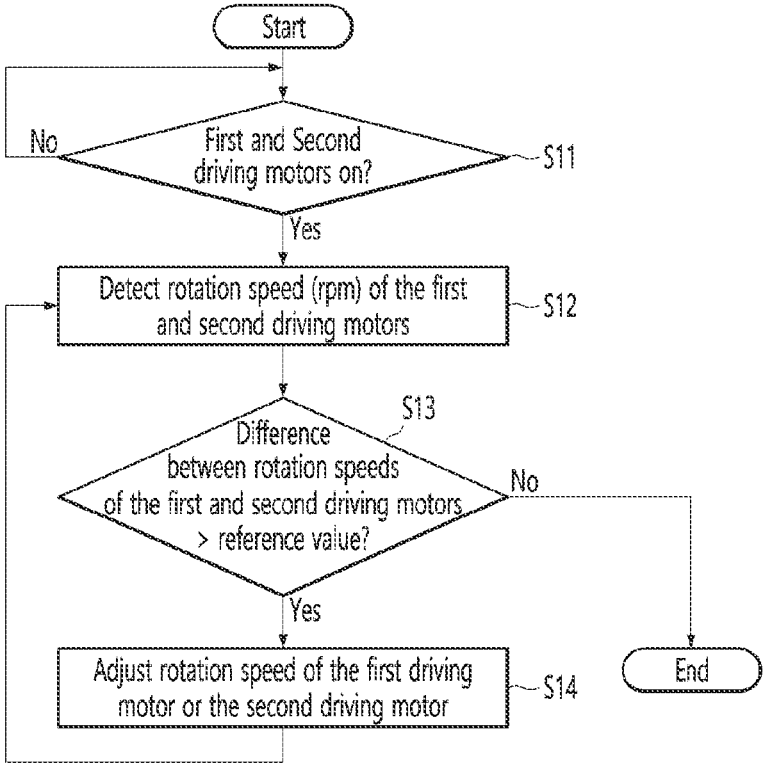
FIG. 32 is a flowchart illustrating a method of controlling a nozzle of a cleaner according to another embodiment of the present disclosure.
Figure 33:
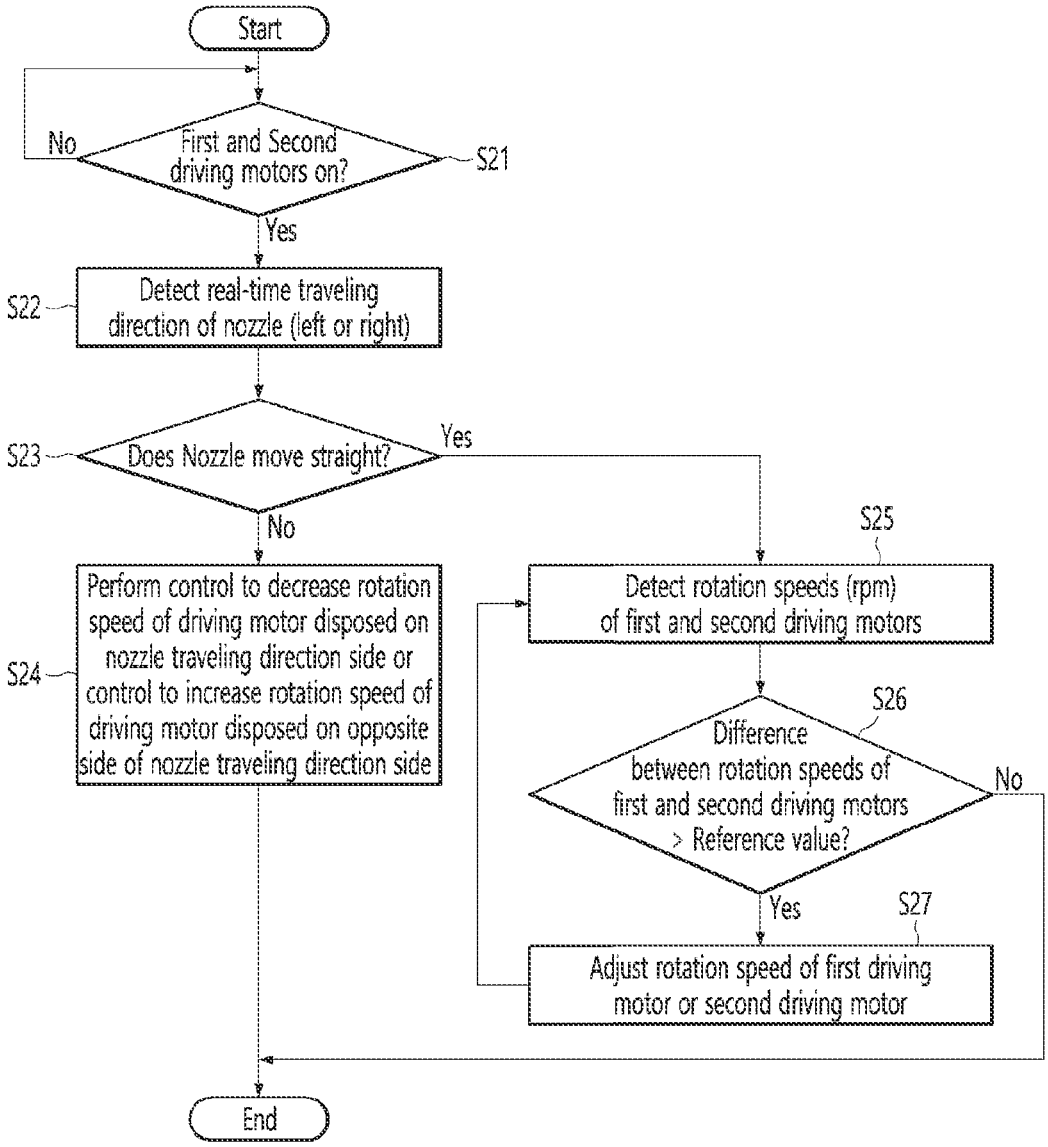
FIG. 33 is a flowchart illustrating a method of controlling a nozzle of a cleaner according to still another embodiment of the present disclosure.

FIG. 32 is a flowchart illustrating a method of controlling a nozzle of a cleaner according to another embodiment of the present disclosure. FIG. 33 is a flowchart illustrating a method of controlling a nozzle of a cleaner according to another embodiment of the present disclosure.

First, referring to FIG. 32, a method for controlling a nozzle of a cleaner according to the present disclosure may include: turning on the first and second driving motors 182 and 184 (S11); detecting, by the first and second sensing units 361 and 362, the rotation speeds of the first and second driving motors 182 and 184, respectively (S12); comparing, by the control unit 370, the rotation speeds of the first and second driving motors 182 and 184 (S13); and selectively adjusting the rotation speeds of the first and second driving motors 182 and 184 according to the comparison result (S14).

For example, when it is determined in operation S13 that the difference between the rotation speeds of the first and second driving motors 182 and 184 is greater than the reference value set by the user, in operation S14, the control unit 370 controls the output of the driving motor so that the rotation speed of the driving motor having a relatively low rotation speed is increased. As described above, after the output control of the driving motor is performed, operations S12 to S14 may be repeated until the difference between rotation speeds of the first and second driving motors 182 and 184 is less than or equal to the reference value set by the user.

As another example, when it is determined in operation S13 that the difference between the rotation speeds of the first and second driving motors 182 and 184 is greater than the reference value set by the user, in operation S14, the control unit 370 controls the output of the driving motor so that the rotation speed of the driving motor having a relatively high rotation speed is decreased. As described above, after the output control of the driving motor is performed, operations S12 to S14 may be repeated until the difference between rotation speeds of the first and second driving motors 182 and 184 is less than or equal to the reference value set by the user.

As still another example, when it is determined in operation S13 that the difference between the rotation speeds of the first and second driving motors 182 and 184 is less than or equal to the reference value set by the user, in operation S14, the control unit 370 may control the rotation speeds of the first and second driving motors 182 and 184 to be maintained.

Meanwhile, referring to FIG. 33, a method for controlling a nozzle of a cleaner according to another embodiment of the present disclosure includes: turning on the first and second driving motors 182 and 184 (S21); detecting, by the direction detection sensor 363, a change in the traveling direction of the nozzle main body 10 (S22); determining whether the nozzle main body 10 moves straight (S23); and selectively adjusting the rotation speeds of the first and second driving motors 182 and 184 according to whether the direction of the nozzle main body 10 is changed or whether the nozzle main body 10 moves straight (S24).

As an example, when the change in the traveling direction of the nozzle main body 10 by the user is detected and the direction of the nozzle main body 10 is detected as the left in operation S22, it is determined in operation S23 that the nozzle main body 10 does not move straight. In operation S24, the output of the corresponding motor can be controlled so that the rotation speed of the first driving motor 182 disposed on the left (based on FIG. 20) is lower than the rotation speed of the second driving motor 184 disposed on the right (based on FIG. 20).

In this case, the control unit 370 may control the rotation speed of the first driving motor 182 to be lower than the rotation speed of the second driving motor 184 by lowering the output of the first driving motor 182.

In addition, the control unit 370 may control the rotation speed of the first driving motor 182 to be lower than the rotation speed of the second driving motor 184 by increasing the output of the second driving motor 184.

As another example, when the change in the traveling direction of the nozzle main body 10 by the user is detected and the direction of the nozzle main body 10 is detected as the right in operation S22, it is determined in operation S23 that the nozzle main body 10 does not move straight. In operation S24, the output of the corresponding motor can be controlled so that the rotation speed of the second driving motor 184 disposed on the right (based on FIG. 20) is lower than the rotation speed of the first driving motor 182 disposed on the left (based on FIG. 20).

In this case, the control unit 370 may control the rotation speed of the second driving motor 184 to be lower than the rotation speed of the first driving motor 182 by lowering the output of the second driving motor 184.

In addition, the control unit 370 may control the rotation speed of the second driving motor 184 to be lower than the rotation speed of the first driving motor 182 by increasing the output of the first driving motor 182.

As still another example, when the change in the traveling direction of the nozzle main body 10 by the user is not detected in operation S22, it is determined in operation S23 that the nozzle main body 10 is moving straight. The first and second sensing units 361 and 362 detect the rotation speeds of the first and second driving motors 182 and 184, respectively (S25). Thereafter, the control unit 370 compares the rotation speeds of the first and second driving motors 182 and 184 (S26). According to the comparison result of operation S26, the rotation speeds of the first and second driving motors 182 and 184 are selectively adjusted (S27).

For example, in operation S27, when it is determined in operation S26 that the difference between the rotation speeds of the first and second driving motors 182 and 184 is greater than the reference value set by the user, the control unit 370 controls the output of the driving motor so that the rotation speed of the driving motor having a relatively low rotation speed is increased. As described above, after the output control of the driving motor is performed, operations S25 to S27 may be repeated until the difference between rotation speeds of the first and second driving motors 182 and 184 is less than or equal to the reference value set by the user.

As another example, in operation S27, when it is determined in operation S26 that the difference between the rotation speeds of the first and second driving motors 182 and 184 is greater than the reference value set by the user, the control unit 370 controls the output of the driving motor so that the rotation speed of the driving motor having a relatively high rotation speed is decreased. As described above, after the output control of the driving motor is performed, operations S25 to S27 may be repeated until the difference between rotation speeds of the first and second driving motors 182 and 184 is less than or equal to the reference value set by the user.

As still another example, in operation S27, when it is determined in operation S26 that the difference between the rotation speeds of the first and second driving motors 182 and 184 is less than or equal to the reference value set by the user, the control unit 370 may control the rotation speeds of the first and second driving motors 182 and 184 to be maintained.

According to the present disclosure, there is an advantage that can prevent the nozzle main body from changing the direction arbitrarily by rotating the mops disposed on both sides of the nozzle main body at the same or similar speeds, and can improve the straight running performance of the nozzle main body. In addition, since the user can operate the handle connected to the nozzle main body without exerting great effort, the user's convenience of operation during the cleaning process can be improved and the user fatigue can be reduced. In addition, the user can more easily change the traveling direction of a nozzle main body with less force without exerting great force.

What is claimed is:

1. A nozzle of a cleaner comprising:

a nozzle main body having a suction flow path through which air is suctioned;

a first rotation cleaning unit and a second rotation cleaning unit spaced apart in a left and right direction on a lower side of the nozzle main body, each of the first rotation cleaning unit and the second rotation cleaning unit including a rotation plate to which a mop is attachable;

a first driving device disposed on one side of a flow path extending in a front and rear direction in the suction flow path and including a first driving motor for driving the first rotation cleaning unit;

a second driving device disposed on the other side of the flow path extending in the front and rear direction in the suction flow path and including a second driving motor for driving the second rotation cleaning unit;

a water tank detachably mounted on an upper side of the nozzle main body and configured to store water to be supplied to each of the first and second rotation cleaning units;

a water supply flow path provided in the nozzle main body and communicating with the water tank so as to supply water from the water tank to each of the first and second rotation cleaning units;

a first sensing unit configured to sense a rotation speed of the first driving motor;

a second sensing unit configured to sense a rotation speed of the second driving motor; and a control unit configured to compare the rotation speeds of the first and second driving motors sensed by the first and second sensing units, and selectively adjust the rotational speeds of the first and second driving motors according to a comparison result.

2. The nozzle according to claim 1, wherein the control unit is configured to control an output to increase a rotation speed of a driving motor having a low rotation speed when a difference between the rotation speeds of the first and second driving motors is greater than a reference value.

3. The nozzle according to claim 1, wherein the control unit is configured to control an output to decrease a rotation speed of a driving motor having a high rotation speed when a difference between the rotation speeds of the first and second driving motors is greater than a reference value.

4. The nozzle according to claim 1, wherein the control unit is configured to maintain the rotation speeds of the first and second driving motors when a difference between the rotation speeds of the first and second driving motors is less than or equal to a reference value.

5. The nozzle according to claim 1, wherein each of the first and second sensing units comprises:

first and second magnets coupled to rotation shafts of the first and second driving motors to rotate; and first and second hall sensors mounted on the control unit to face the first and second magnets and configured to count the number of rotations of the first and second magnets.

6. The nozzle according to claim 1, further comprising a direction detection sensor configured to sense a change in a traveling direction of the nozzle main body and transmit the sensed change to the control unit.

7. The nozzle according to claim 6, wherein, when the direction detection sensor senses a direction change of the nozzle main body to a left side, the control unit is configured to control an output so that the rotation speed of the first driving motor disposed on the left is less than the rotation speed of the second driving motor disposed on the right.

8. The nozzle according to claim 6, wherein, when the direction detection sensor senses a direction change of the nozzle main body to a right side, the control unit is configured to control an output so that the rotation speed of the second driving motor disposed on the right is less than the rotation speed of the first driving motor disposed on the left.

9. The nozzle according to claim 1, wherein the suction flow path comprises:

a first flow path extending in the left and right direction from a front end of the nozzle main body; and a second flow path extending in the front and rear direction from a central portion of the first flow path, wherein the first and second driving devices are positioned behind the first flow path, and the second flow path is positioned between the first driving device and the second driving device.

10. The nozzle according to claim 9, wherein the water tank comprises:

a first chamber positioned above the first driving motor;

a second chamber positioned above the second driving motor; and a connection chamber connecting the first chamber and the second chamber in a region between the first flow path and each of the driving motors.

11. The nozzle according to claim 1, wherein the first rotation cleaning unit comprises a first rotation plate to which a mop is attachable and which has a first rotation center, wherein the second rotation cleaning unit comprises a second rotation plate to which a mop is attachable and which has a second rotation center, and wherein an axis line of the first driving motor and an axis line of the second driving motor are positioned between the first rotation center and the second rotation center.

12. The nozzle according to claim 1, wherein the nozzle main body comprises a nozzle housing in which the driving devices are accommodated, wherein the nozzle housing comprises a driving unit cover that covers each of the driving devices and is convex upward, and wherein a portion of the water tank surrounds the periphery of the driving unit cover in a state where the water tank is mounted on the nozzle main body.

13. The nozzle according to claim 1, wherein the mop is attached to a lower side of the rotation plate, and the rotation plate has a plurality of water passage holes through which water discharged from the water supply flow path passes.

14. The nozzle according to claim 1, wherein the water tank comprises:

a tank body having a chamber in which water is stored and a discharge port through which water is discharged; and a valve having an opening and closing unit that opens or closes the discharge port in the tank body, wherein the nozzle main body includes a valve operating unit configured to operate the opening and closing unit while the water tank is mounted on the nozzle main body, so that the opening and closing unit opens the discharge port, and the water supply flow path is connected to the valve operating unit.

15. The nozzle according to claim 1, wherein the water supply flow path comprises:

a supply tube through which water discharged from the water tank flows;

a connector connected to the supply tube;

a first branch tube connected to the connector and configured to supply water to the first rotation cleaning unit; and a second branch tube connected to the connector and configured to supply water to the second rotation cleaning unit.

16. A method for controlling a nozzle of a cleaner, the cleaner including:

a nozzle main body having a suction flow path through which air is suctioned;

a first rotation cleaning unit and a second rotation cleaning unit spaced apart in a left and right direction on a lower side of the nozzle main body, each of the first rotation cleaning unit and the second rotation cleaning unit including a rotation plate to which a mop is attachable;

a first driving device disposed on one side of a flow path extending in a front and rear direction in the suction flow path and including a first driving motor for driving the first rotation cleaning unit;

a second driving device disposed on the other side of the flow path extending in the front and rear direction in the suction flow path and including a second driving motor for driving the second rotation cleaning unit;

a water tank detachably mounted on an upper side of the nozzle main body and configured to store water to be supplied to each of the first and second rotation cleaning units;

a water supply flow path provided in the nozzle main body and communicating with the water tank so as to supply water from the water tank to each of the first and second rotation cleaning units;

a first sensing unit configured to sense a rotation speed of the first driving motor;

a second sensing unit configured to sense a rotation speed of the second driving motor; and a control unit, the method comprising:

turning on the first and second driving motors;

detecting, by the first and second sensing units, rotation speeds of the first and second driving motors, respectively;

comparing, by the control unit, the rotation speeds of the first and second driving motors; and selectively adjusting the rotation speeds of the first and second driving motors according to a comparison result.

17. The method according to claim 16, wherein, when it is determined from the comparison result that a difference between the rotation speeds of the first and second driving motors is greater than a reference value, the control unit controls an output to increase a rotation speed of a driving motor having a low rotation speed.

18. The method according to claim 16, wherein, when it is determined from the comparison result that a difference between the rotation speeds of the first and second driving motors is greater than a reference value, the control unit controls an output to decrease a rotation speed of a driving motor having a high rotation speed.

19. The method according to claim 16, further comprising:

detecting, by a direction detection sensor, a change in a traveling direction of a nozzle main body; and selectively adjusting rotation speeds of the first and second driving motors according to whether the direction of the nozzle main body is changed.

20. The method according to claim 19, wherein, when a direction change of the nozzle main body to a left side is detected, the control unit controls an output so that the rotation speed of the first driving motor disposed on the left is less than the rotation speed of the second driving motor disposed on the right.

21. The method according to claim 19, wherein, when a direction change of the nozzle main body to a right side is detected, the control unit controls an output so that the rotation speed of the second driving motor disposed on the right is less than the rotation speed of the first driving motor disposed on the left.

* * * * *